US008202070B2

(12) United States Patent
Didin et al.

(10) Patent No.: US 8,202,070 B2
(45) Date of Patent: Jun. 19, 2012

(54) SPHERICAL POSITIVE DISPLACEMENT ROTARY MACHINE

(76) Inventors: Alexandr Vladimirovich Didin, Pereslavl-Zalessky (RU); Ilya Yakovlevich Yanovsky, Krasnodar (RU)

( * ) Notice: Subject to any disclaimer, the term of this patent is extended or adjusted under 35 U.S.C. 154(b) by 674 days.

(21) Appl. No.: 12/303,184

(22) PCT Filed: Jun. 5, 2007

(86) PCT No.: PCT/RU2007/000302

§ 371 (c)(1),
(2), (4) Date: Dec. 2, 2008

(87) PCT Pub. No.: WO2007/142557

PCT Pub. Date: Dec. 13, 2007

(65) Prior Publication Data

US 2009/0185937 A1 Jul. 23, 2009

(30) Foreign Application Priority Data

Jun. 6, 2006 (RU) ..... 2006119771

(51) Int. Cl.

| | |
|---|---|
| ***F01C 3/00*** | (2006.01) |
| ***F03C 2/00*** | (2006.01) |
| ***F03C 4/00*** | (2006.01) |
| ***F04C 18/00*** | (2006.01) |

(52) U.S. Cl. ..... 418/68; 418/7; 418/104; 418/107; 418/112; 418/163; 418/195; 123/18 R; 123/241

(58) Field of Classification Search ..... 418/162, 418/68, 195, 163, 7, 104, 107, 112, 153–155; 123/18 R, 241

See application file for complete search history.

(56) References Cited

U.S. PATENT DOCUMENTS

| | | | | |
|---|---|---|---|---|
| 143,723 | A * | 10/1873 | Shaw et al. | 418/163 |
| 826,985 | A * | 7/1906 | Appel | 418/68 |
| 1,904,373 | A * | 4/1933 | Kempthorne | 418/68 |
| 1,952,260 | A * | 3/1934 | Kempthorne | 418/68 |

(Continued)

FOREIGN PATENT DOCUMENTS

| | | |
|---|---|---|
| DE | 878755 | 6/1953 |

(Continued)

OTHER PUBLICATIONS

Written Opinion and International Search Report for PCT Appln. No. PCT/RU2007/000370 mailed Nov. 22, 2007 with English Translation.

*Primary Examiner* — Mary A Davis
(74) *Attorney, Agent, or Firm* — Warner Norcross & Judd LLP

(57) ABSTRACT

A positive displacement rotary machine with a body having an internal spherical cavity, a rotor, and a ring working cavity formed by the body and the rotor. The working cavity is functionally divided into bypass and propulsion halves. A separator embodied in the form of a wobble plate is mounted in the working cavity at an angle to the rotor. A piston with a sealable through-slot for the separator passage is mounted in a slot made in the rotor. Multiple openings made through the separator in the propulsion half of the cavity make the separator transparent for the working medium flow. The openings are small enough so the separator seals the through-slot of the piston. The configuration allows for one input port and one output port on the opposite sides of the separator in the bypass half to make the supply steady.

16 Claims, 27 Drawing Sheets

U.S. PATENT DOCUMENTS

| | | | | |
|---|---|---|---|---|
| 2,318,386 | A * | 5/1943 | Haines | 418/163 |
| 2,708,413 | A | 5/1955 | Loewen | |
| 2,832,198 | A | 4/1958 | Pichon | |
| 3,184,154 | A | 5/1965 | May et al. | |
| 3,408,991 | A | 11/1968 | Davis | |
| 5,171,142 | A | 12/1992 | Proglyada | |
| 5,351,657 | A | 10/1994 | Buck | |
| 6,941,900 | B1 | 9/2005 | Malinov | |
| 2009/0185925 | A1 * | 7/2009 | Didin et al. | 418/1 |

FOREIGN PATENT DOCUMENTS

| | | | |
|---|---|---|---|
| DE | 3146782 | | 11/1981 |
| DE | 3206286 | | 2/1982 |
| GB | 1458459 | | 12/1976 |
| GB | 2052639 | A * | 1/1981 |
| RU | 2134796 | | 8/1999 |
| RU | 2301345 | | 4/2006 |
| RU | 2376478 | | 1/2008 |

* cited by examiner

SPHERICAL POSITIVE DISPLACEMENT ROTARY MACHINE

FIELD OF THE INVENTION

The invention relates to machine-building industry that is to positive displacement rotary machines which can be used as pumps, compressors, hydraulic drives and others.

BACKGROUND OF THE INVENTION

A positive displacement rotary machine (PDRM) (RU 2004133654) having a body with an internal ring cavity is known. A spiral separator with a rotor inside is installed in this cavity. The rotor working surface is a surface of rotation, where there is at least one slot along the rotation axis of the rotor, in each of which a piston partly extending (projecting) from one side of the rotor is rotatably mounted. Besides, the piston has at least one through-slot across its perimeter interacting with the separator for the piston and the rotor rotation synchronization. The machine inlet and outlet openings are spaced along the rotor axis and separated from each other by the separator.

Such machine has the following advantages.

The piston is securely installed in the rotor slot extending from it for about a halfway. The inlet and outlet openings spacing configuration along the rotor axis facilitates combination of such machines into multistage machines including those with a common rotor for multiple stages. Such machines are used in submersible units. The common rotor enables the reduction of radial load and often thrust load on the bearings of the rotor by balancing the loads on the individual stages in case the stages are turned relative to each other.

An essential advantage of the pump, produced on the basis of this machine, is the uniform flow rate.

Disadvantage of such machines is a complicated configuration of the separator and the piston slot that does not allow contact between them over a large area in order to reduce wear of the friction pair (to reduce an ideal load on the friction pair and extend its service life).

A PDRM is known (GB 1458459 and similar to it DE 3206286 A1), the body of which contains a cavity in the form of a spherical segment, in which a separator is installed along the axis of symmetry of the cavity shaped as a sector of a circle closing off the cavity; a rotor installed inside the body and capable of rotation has the working surface in the form of two truncated cones resting with their tops on a sphere from the opposite sides, while on the surface of the sphere, at an angle to the axis of symmetry of the rotor, there is a circular groove positioned tangentially with respect to both cones. A piston with a through-slot, allowing the passing through of the separator, is rotatably mounted in this groove. The piston interacts with the separator through a sealing synchronizing element (SSE), embodied in the form of a cylinder sectioned in half by a through-slot, which begins at one end and extends most of the way to the other end. The working medium inlet opening and corresponding outlet opening are located on the same side of the piston. On the other side of the piston there is one more pair of inlet and outlet openings.

Such a machine has the following advantages: a good contact of the piston with the body chamber along the spherical surface, a good contact between the piston, the sealing element and the separator, simple geometrical forms: the flat separator, the flat piston and others.

PDRM also has disadvantages: the difficulty of combining such a machine into a multi-stage machine, associated with the fact that the inlet and outlet openings are located on the same side of the piston, and in order to get from one stage to another, a channel is required bypassing the spherical cavity of the body along the rotor axis. Also considered as disadvantages are: non-uniform flow rate, weak mounting of the piston (which is only partially located inside the groove on the sphere), which also weakens the shaft due to the circular groove, unreliable mounting of the sealing synchronizing element in the slot of the piston (jamming is possible under increased loads).

The PDRM (DE 3146782 A1), having a body with a cavity in the form of spherical segment and a rotatably mounted rotor with through-slot along the rotor axis, is known. There is also a piston in the form of a disk rotatably mounted in the rotor slot, a chamber in the form of spherical segment partitioned by a separator in the direction of the rotor rotation as well as outlet and inlet openings located in front of and behind the separator accordingly. Besides, the piston rotation is synchronized with the rotor rotation by means of a shaft, fixedly going through the rotor, and the system of gears, one of which is fixed at the piston.

Advantages of this machine include spherical contact between the piston and the chamber, reliable mounting of the piston extending towards both sides from the shaft, presence of a strong shaft (longitudinal slot barely weakens it), possibility to arrange (to space) the inlet and outlet openings along the shaft to combine several stages on one shaft, independence of leaks on the wear of synchronizing mechanism, and possibility of high rotation speed.

Unreliable synchronizing mechanism, especially in case if the gear shaft is required to pass through several stages, is referred to as disadvantage.

A positive displacement rotary machine (application RU 2006119356), comprising a body, working surface of which is made in the form of a spherical segment part; a rotor rotatably mounted in the body and having a working surface of rotation; a ring concentric working cavity formed by the body and the rotor; a separator in the form of the inclined washer, geometrical axis of which is inclined to the geometrical axis of the rotor rotation, fixedly mounted in the body and dividing the working cavity into two parts, is known; besides at least one slot is made on the rotor working surface along its geometrical axis of rotation; a piston, which can close off (seal) the working cavity and oscillate rotationally about its geometrical axis intersecting geometrical axis of the rotor, is mounted in the rotor; moreover, the piston is made at least in the form of a part of a disk and there is at least one sealing through-slot for the separator passage in each piston.

The advantages of this machine are spherical contact of the piston and the chamber, reliable fastening of the piston extending from the shaft in both sides, the strength shaft availability (the longitudinal slot looses it a little), the reliable piston synchronization, the good piston sealing.

The PDRM also has the following disadvantages: difficulty of combining such a machine into a multistage machine associated with the fact that corresponding the inlet and outlet openings are located on the same side of the separator; therefore it is necessary to make a duct going around the body spherical cavity along the rotor axis for passing from stage to stage. Non-uniform flow rate, contributing to difficulty of combining into a multistage machine, is also referred to as disadvantage.

The object of this invention is to develop a positive displacement high-speed rotary machine of high tightness with strength shaft, reliable fastening of the displacement element (the piston), the reliable synchronizing mechanism, allowing multiple short-time overloads, long service life and low inertial loads from the piston side on the synchronizing mechanism. These features allow using the machine in multistage submersible pumps, producing high pressure and having a large margin of strength, as well as give possibility of restarting after a sustained interruption or short-time changes of working medium properties (for example, solidification).

Besides, the machine shall have good specific characteristics: large flow rate at a specified overall diameter, high working pressure per a stage, large margin of strength at short-time pressure increase per a stage, long service life due to both design and possibility of using wear-resistant materials in it.

The desired effect can be achieved due to making through-holes, for working medium flowing to the other separator side, at one of the separator areas (for example, the descending area) in the machine according to application RU 2006119356. In that case, the working medium inlet and outlet openings can be made in the body under and above the ascending area of the separator that is favorable for a multistage machine. Besides, the flow rate (displacement) of such machine becomes almost uniform. Moreover, the separator area with through-passes to the other side continues to seal the piston slot (or SSE slot if it is used) and participate in the piston synchronization.

The assigned task is achieved due to the fact that according to the invention, the positive displacement rotary machine comprising the body, working surface of which is embodied in the form of a part of segment of a torus; a rotor with a working surface of rotation, rotatably mounted in the body; a ring working cavity, formed by the working surfaces of the body and the rotor; a separator in the form of a washer, fixedly mounted in the body and dividing the working cavity at an angle to the plane of the rotor rotation into two parts; where the separator has two conditional areas, the ascending and descending areas, with approximate boundary at the two opposite separator points, located along the rotor axis at a maximum distance from each other; moreover at least one slot is made on the rotor working surface along its geometrical axis of rotation and the piston, which can close off (seal) the working cavity and oscillate rotationally in the plane of the slot, is mounted in each slot of the rotor; besides, the piston is made at least in the form of a part of a disk and there is at least one sealing through-slot for the separator in each piston, is characterized in that at least one through-pass is made at one of the separator parts (at the descending area) to enable a working medium flow from one side of the separator to the other.

According to the invention, the body working surface is made in the form of a spherical segment (the sphere is a particular case of torus, the circular axis radius of which is equal to zero).

According to the invention, the working medium inlet and outlet openings are made at bypass part of the body, under and above the ascending part of the separator accordingly.

According to the invention, the rotor working surface is made in the form of two coaxial surfaces of truncated cones rested with their truncated parts against the sphere.

The assigned task is also achieved due to the fact that according to the invention, the slots on the rotor working surface are connected at the center of the rotor.

The assigned task is also achieved due to the fact that according to the invention, the separator is made in the form of the flat washer.

The assigned task is also achieved due to the fact that according to the invention, the separator is made in the form of a washer with a conical working surface.

The assigned task is also achieved due to the fact that according to the invention, the separator is mounted in the body so that its diametrically opposite parts, located from the opposite sides, is in contact with the rotor.

The assigned task is also achieved due to the fact that according to the invention, recesses are made on the separator at places of contact with the rotor.

The assigned task is also achieved due to the fact that according to the invention, the separator is made in the form of two parts of the washer.

The assigned task is also achieved due to the fact that according to the invention, the washer parts are connected using a “>” type joint (connection).

The assigned task is also achieved due to the fact that according to the invention, the piston is made in the form of a disk with a spherical side surface and two through-slots for the separator.

The assigned task is also achieved due to the fact that according to the invention, the piston is made in the form of the disk with two through-slots for the separator, having weight decrease hollows at the area distant from the slots.

The assigned task is also achieved due to the fact that according to the invention, the piston is made in the form of a truncated disk sector with an angle of less than 180 degrees having one through-slot for the separator.

The assigned task is also achieved due to the fact that according to the invention at least one sealing synchronizing element is mounted in the piston through-slot.

The assigned task is also achieved due to the fact that according to the invention, the sealing synchronizing element is made in the form of a cylinder with through-slots at its ends; besides, the slot planes coincide.

The assigned task is also achieved due to the fact that according to the invention, the piston slot side surfaces are enlarged by means of projections.

The assigned task is also achieved due to the fact that according to the invention, the central part of the sealing synchronizing element is of less diameter.

The assigned task is also achieved due to the fact that according to the invention, the sealing synchronizing element is made in the form of the overlays for the piston slot.

The assigned task is also achieved due to the fact that according to the invention, the sealing synchronizing element is made in the form of two plates, connected by means of the shaft.

The assigned task is also achieved due to the fact that according to the invention, the sealing synchronizing element is made in the form of a roller.

According to the invention at least one pass is made at an angle to the separator geometrical axis.

According to the invention, the machine is made as multistage; besides, the rotor is made as common for all the stages.

According to the invention, ducts for turning the working medium flow around the rotor are made in the body after the first stage and further at intervals of two stages.

THE INVENTION IS EXPLAINED USING THE DRAWINGS

The similar elements are designated by the same numbers on all the figures, where.

1—the body;
2—the body part, ascending half;
3—the body part, descending half;
4—the spherical cavity;
5—the concentric hole for the rotor shaft output;
6—the machine geometrical axis;
7—the rotor;
8—the piston;
9—the separator;
10—the ascending (bypass) part of the separator;
11—the descending (discharge) part of the separator;
12—the inlet opening;
13—the outlet opening;
14—the duct without flow turning around the body;
15—the duct for flow turning around the body;
16—the spherical part of the rotor above the cone;
17—the rotor surface in the form of truncated cone;
18—the central spherical part of the rotor;
19—the rotor shaft output;
20—the working chamber;
21—the slot in the rotor for the piston;
22—the cutout in the rotor for the piston shaft;
23—the recess in the rotor for SSE;
24—the spherical surface of the body;
25—the flat (conic) surface of the separator;
26—the piston geometrical axis;
27—the piston shaft;
28—the piston outer part;
29—the piston central thickened part;
30—the piston through-hole for SSE;
31—the piston spherical side surface;
32—the piston spherical transition part;
33—the piston through-slot for the separator;
34—the recess for the roller in the piston through-slot;
35—the piston through-slot bottom;
36—the piston through-slot side surface;
37—the cylinder on the side surface of the piston through-slot;
38—the cylindrical recess on the side surface of the piston through-slot;
39—the cylindrical hole in the piston to accommodate SSE;
40—the separator joint;
41—the inner spherical surface of the separator;
42—the through-pass in the separator;
43—the separator legs;
44—the sealing synchronizing element (SSE);
45—the SSE through-slot to accommodate the separator;
46—the SSE projections;
47—the pin;
48—the flat or cone-shaped area on the SSE;
49—the side surface of the SSE slot;
50—the bottom of the SSE slot;
51—the SSE spherical end;
52—the SSE cylindrical projection;
53—the SSE cylindrical recess;
54—the SSE plates;
55—the shaft connecting the SSE plates;
56—the roller mounted into the piston slot;
57—the piston weight decrease hollows;
58—a half of the "scissors" type piston;
59—the piston cutout;
60—the cylindrical part of the SSE;
61—the SSE cutout for an articulated cross joint;
62—the hole in the SSE cutout for mounting the axle of the articulated cross;
63—the minimum specific part, 1-st half;
64—the minimum specific part, 2-d half;
65—the area of the slit rotor;
66—the four-stage machine body, 1-st half;
67—the four-stage machine body, 2-d half.

DESCRIPTION OF THE BEST MACHINE EMBODIMENT

Figure 2:
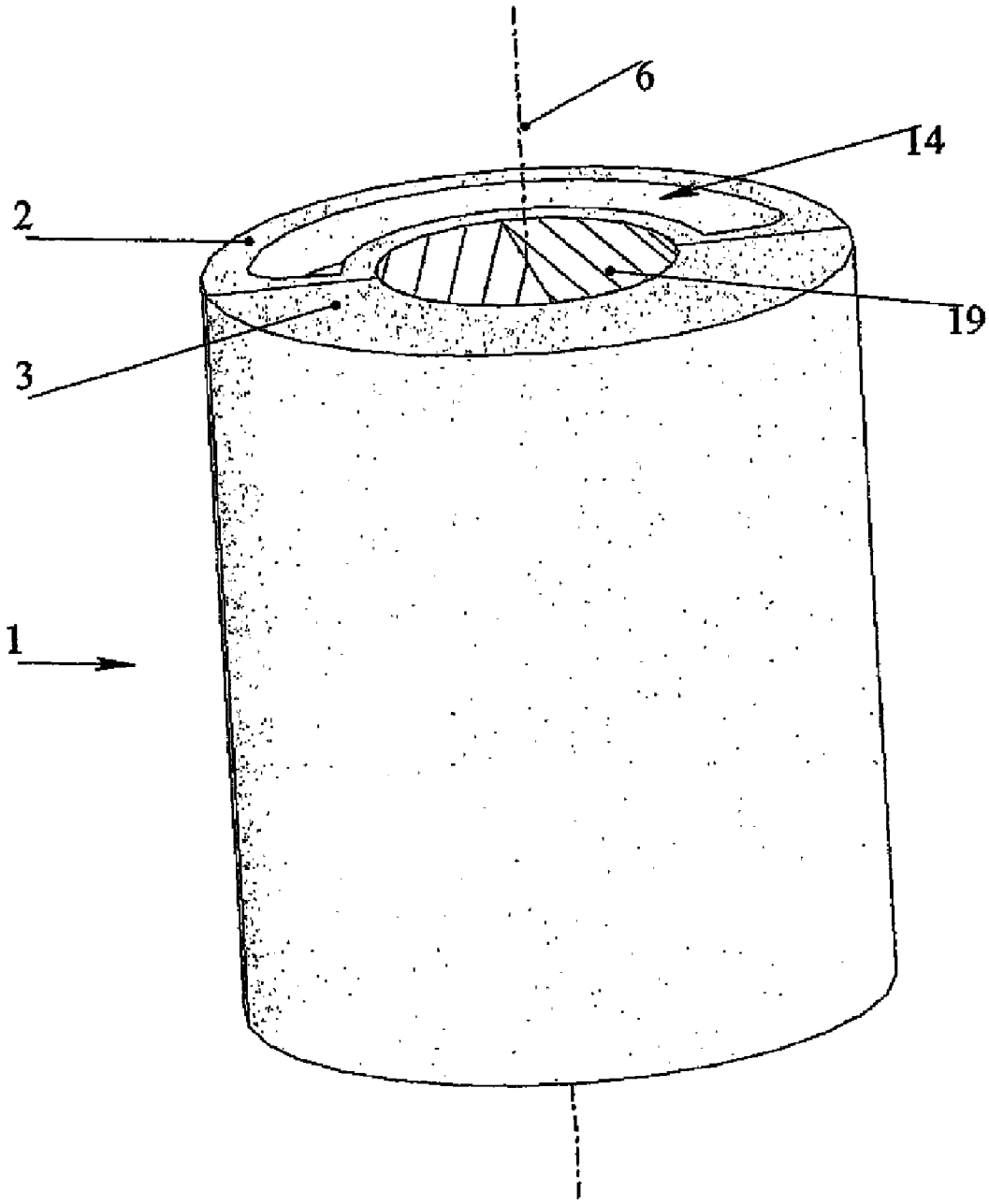
FIG. 2 shows an isometric view of the PDRM appearance; the outlet opening is shown.
Figure 3:
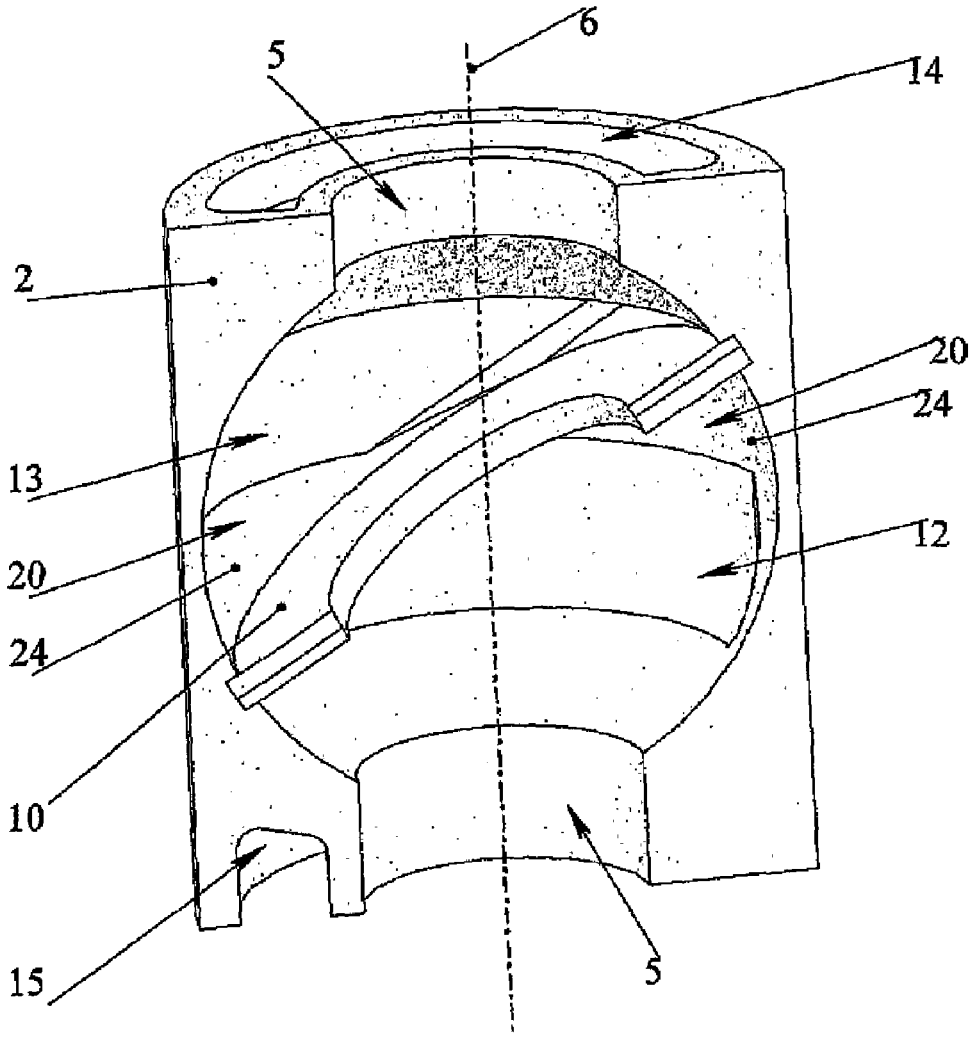
FIG. 3 shows an isometric view of the ascending part of the body.
Figure 4:
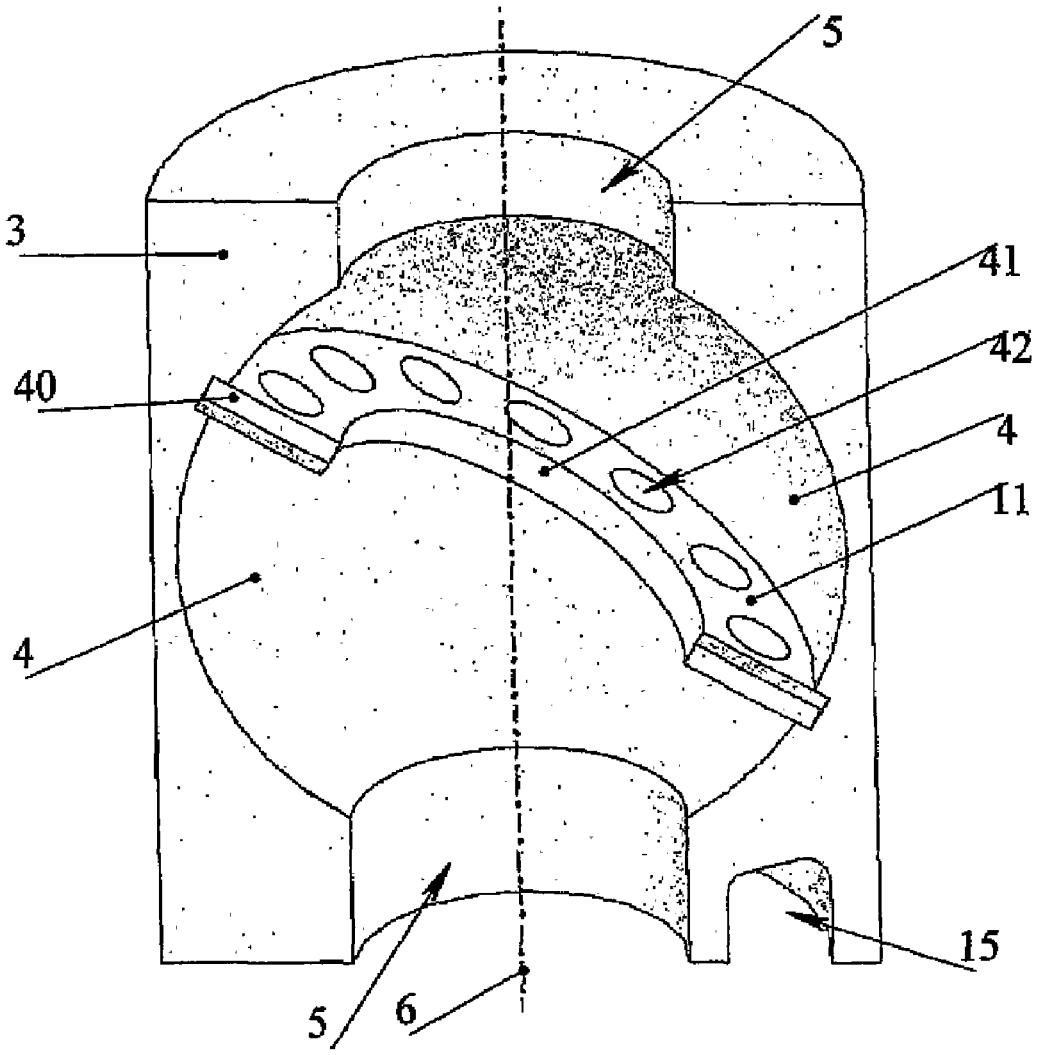
FIG. 4 shows an isometric view of the descending part of the body.
Figure 5:
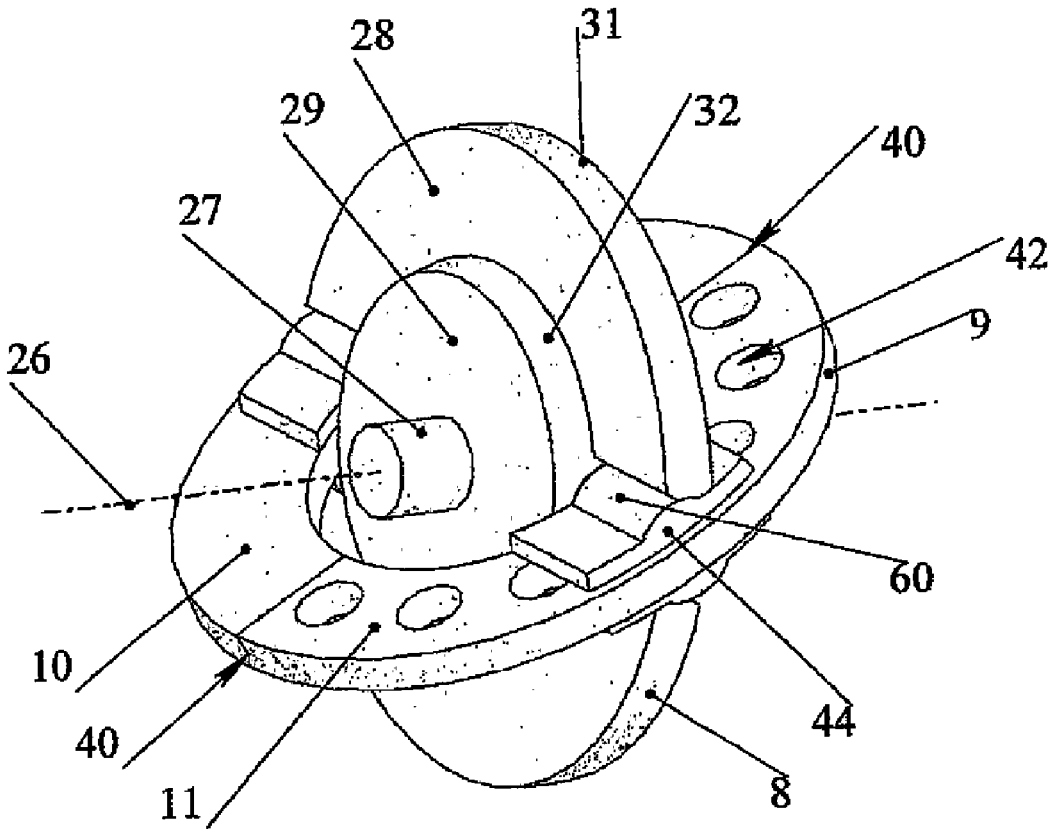
FIG. 5 shows an isometric view of the piston—the separator interaction via the sealing synchronizing element.
Figure 6:
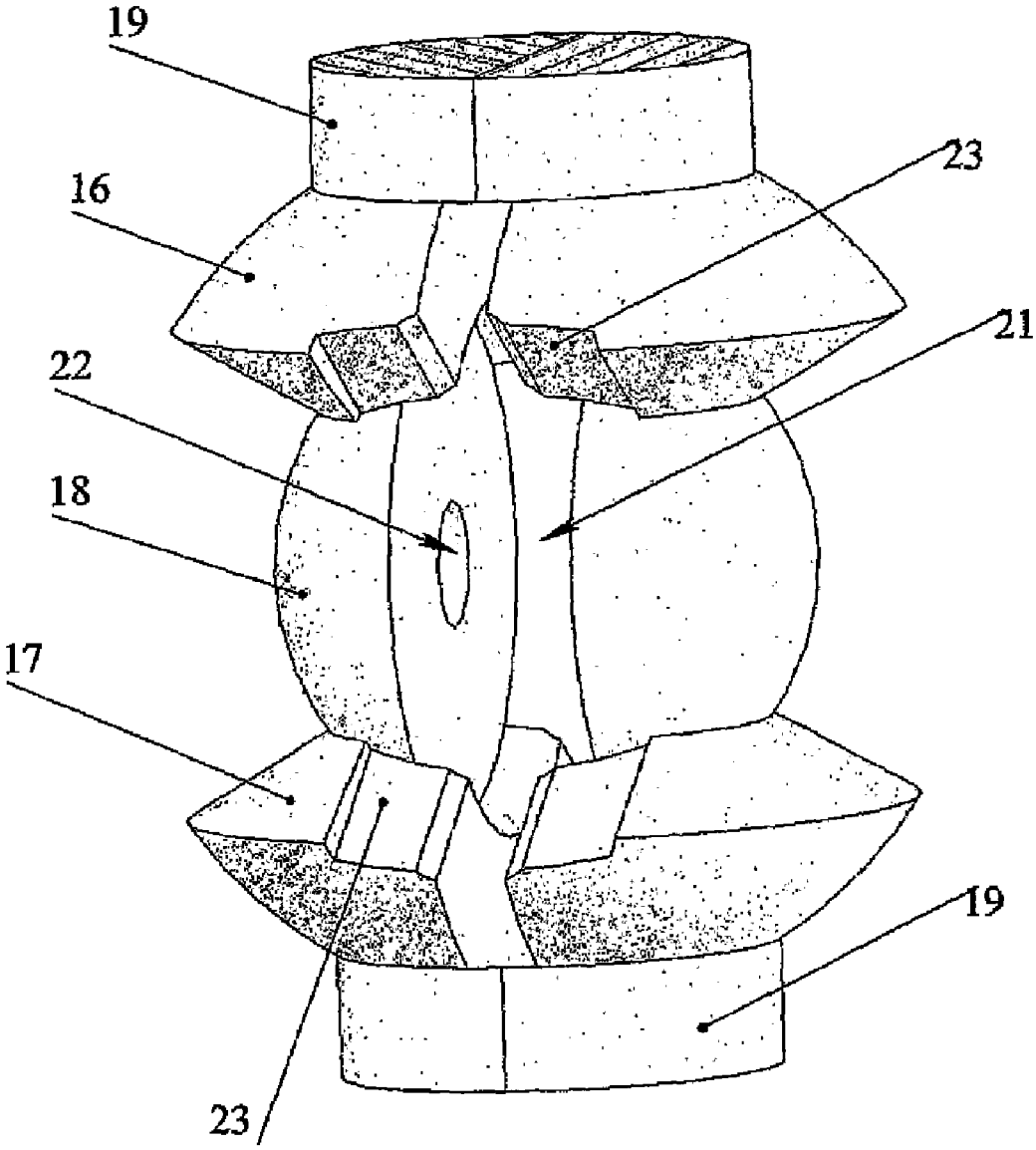
FIG. 6 shows an isometric view of the part of the PDRM shaft.

A positive displacement rotary machine stage (which can be used separately as well) (FIG. 1) is designed as follows. A body 1 (FIG. 2), made of two parts, conditionally (conventionally) called as the ascending (bypass) half 2 (FIG. 3) and the descending (discharge) half 3 (FIG. 4), has a cavity 4 in the form of a segment of a sphere (rather a segment of a torus, which is formed instead of the sphere resulting from tolerances for a rotor axial play) with two holes 5, concentric with it (FIG. 3). A separator 9, made in the form of a washer with an inner spherical hole 41 (FIGS. 1, 3, 4, 5), is mounted in the spherical cavity 4 at an angle to the hole 5 geometrical axis that is the machine geometrical axis 6. To enable assembling, the separator 9 is made of two parts: conditionally ascending (bypass) 10 and descending (discharge) 11, each of which is fixed to the corresponding body parts 2 and 3 (FIGS. 3,4). Through-passes 42 to the other side of the separator 9 are made at one of the separator parts 9, the descending part 11. The rotor 7 with a working surface, made in the form of two surfaces of truncated cones 17 resting with their smaller bases on the central sphere 18 (FIG. 6), is mounted in the body 1 with the rotating capability with respect to the axis 6 of the body 1. The larger bases of the cones 17 are connected with the concentric to them outputs of the shaft 19 by segments of a sphere 16 concentric to the central sphere 18 with radii approximately equal to the radius of the working cavity 4. There is a through slot 21 on the working surface of the rotor 7 along the machine geometrical axis 6 (FIG. 6). For assembling convenience purposes, the rotor 7 is made of two halves. The spherical part 4 of the body, the conic part 17 of the rotor, the central spherical part 18 of the rotor 7 and the separator 9 form a working cavity 20 divided by the separator 9 into two parts (FIG. 1).

Figure 1:
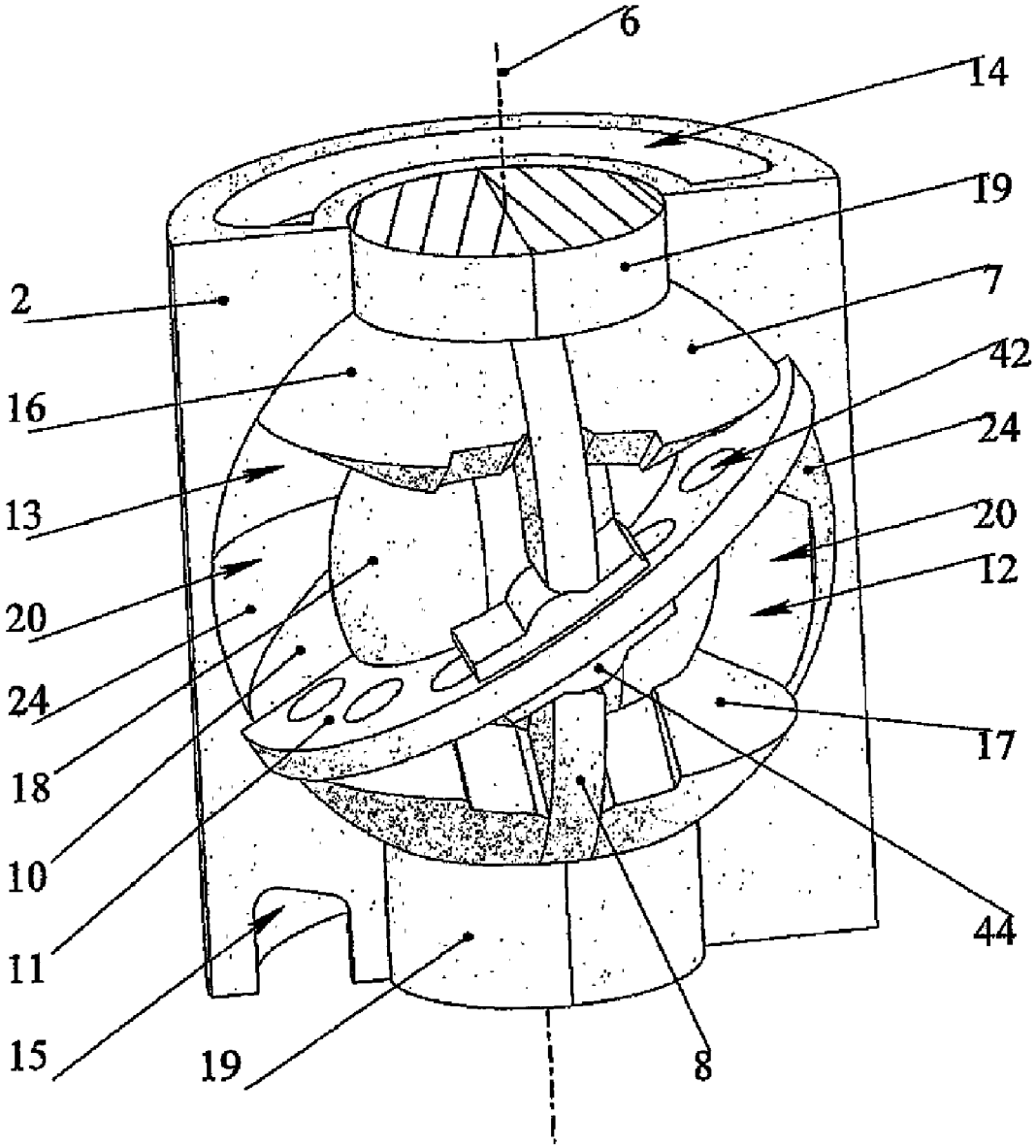
FIG. 1 shows an isometric view of the positive displacement rotary machine stage with the descending part of the body removed (besides, to facilitate understanding, the corresponding part of the separator is left).
Figure 7:
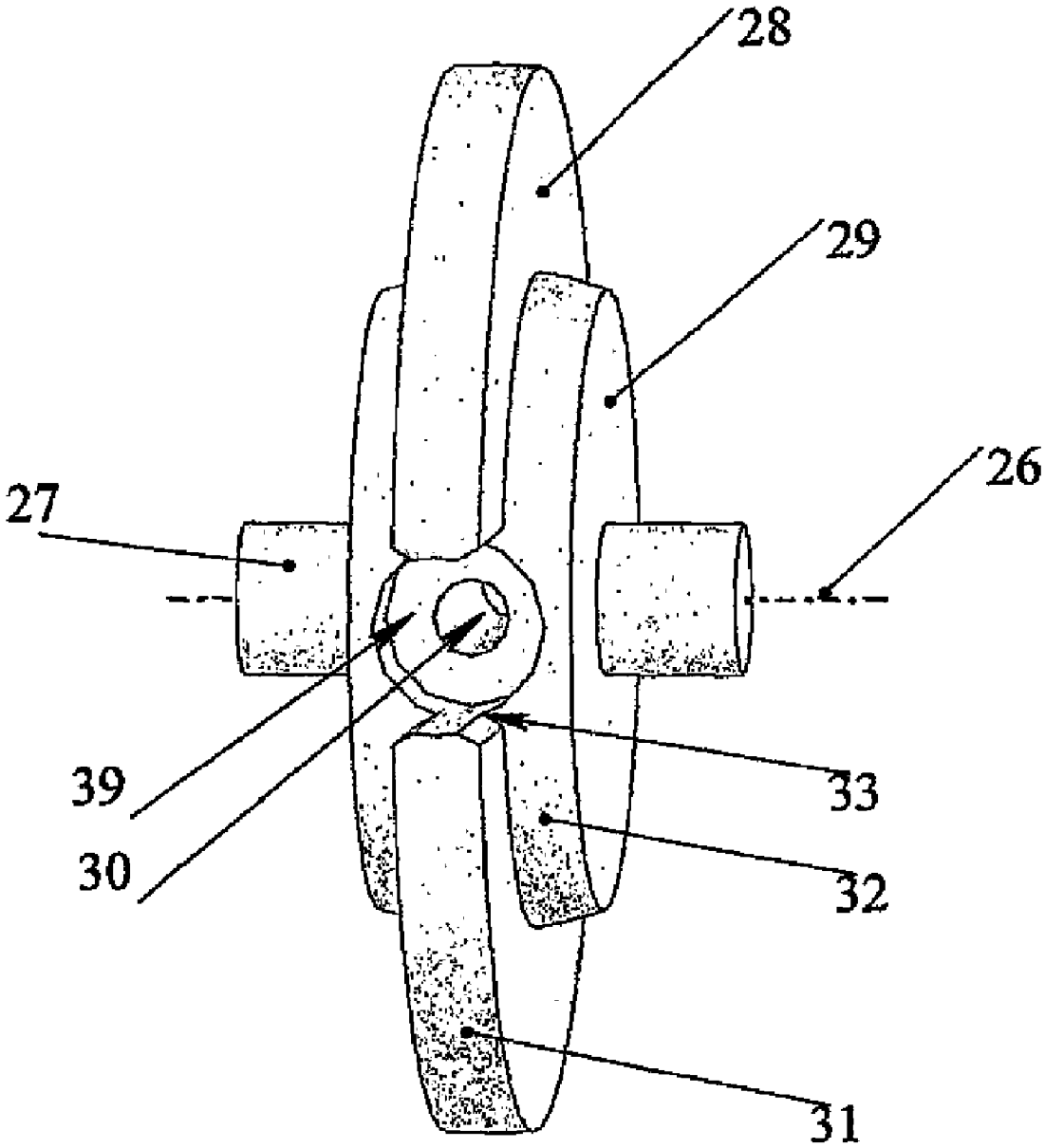
FIG. 7 shows an isometric view of the piston.
Figure 8:
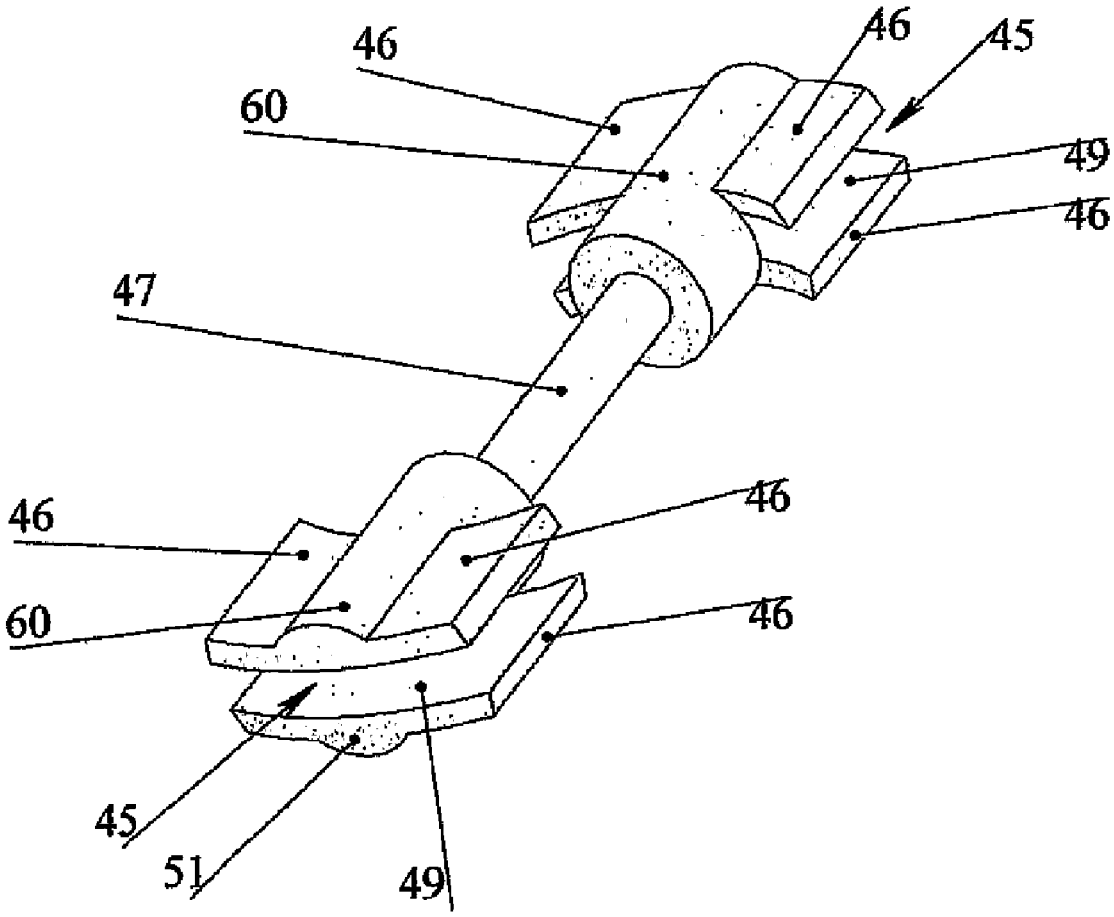
FIG. 8 shows an isometric view of the cylindrical sealing synchronizing element (SSE) with additional projections and the central part of a smaller diameter.
Figure 9:
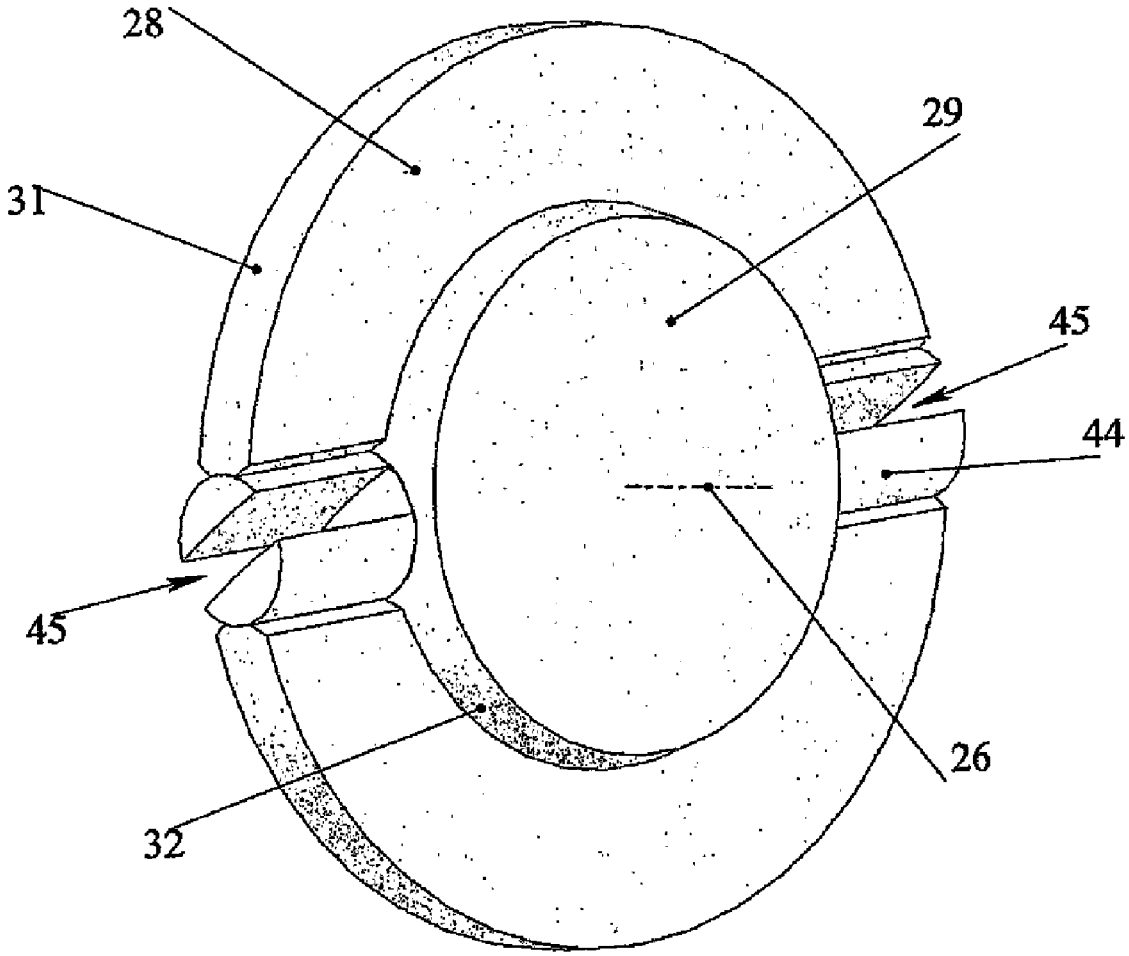
FIG. 9 shows an isometric view of the piston with SSE.
Figure 25:
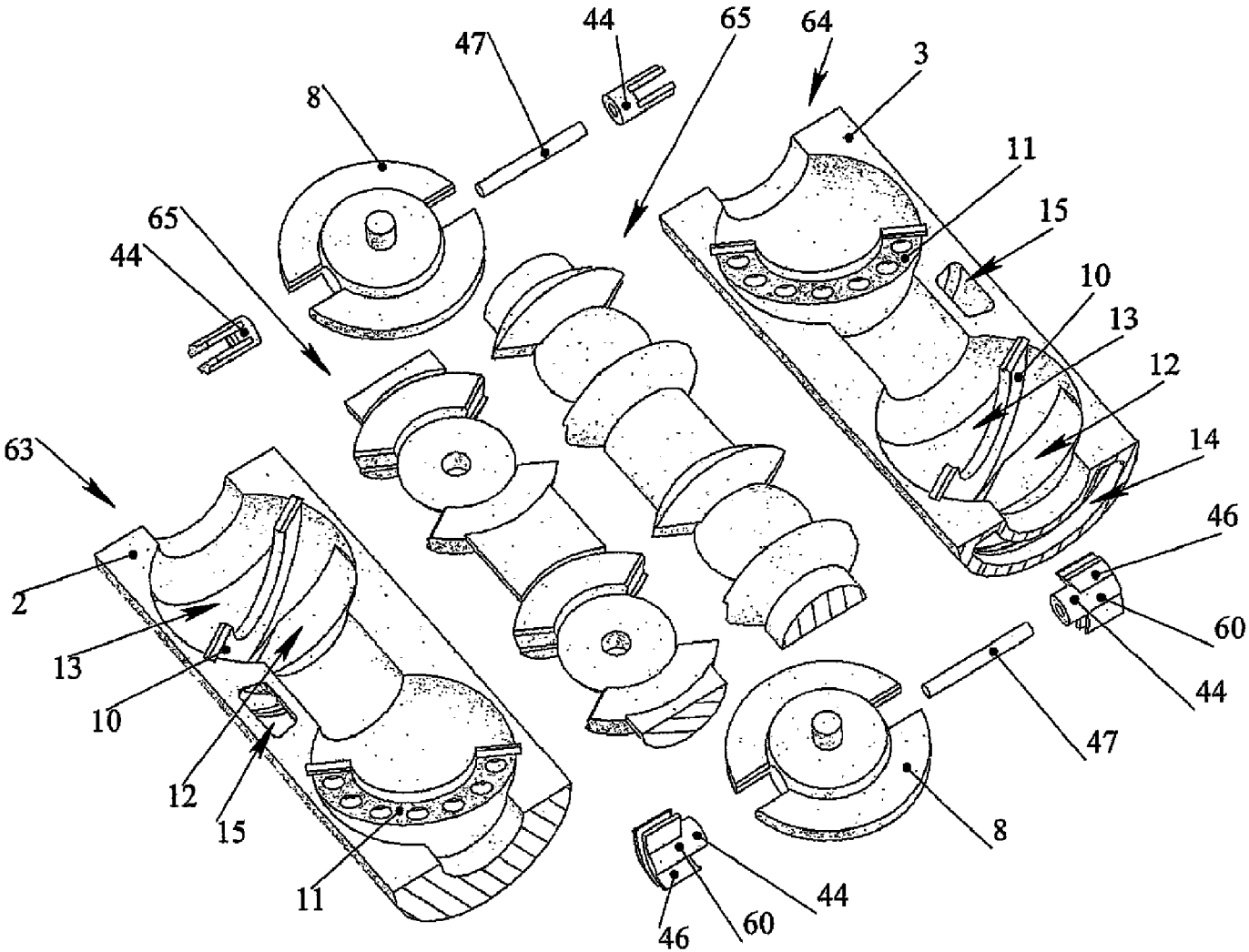
FIG. 25 shows an isometric developed view of the multi-stage machine part consisting of two stages.

The separator 9 touches the rotor 7 conical surface 17 with its opposite sides in two diametrically opposite places (FIG. 1). These touchdown places approximately limit the ascending and descending areas of the separator. Installed in the slot 21 with the capability of rotational oscillations with respect to the geometrical axis 26 perpendicularly intersecting the geometrical axis 6 of the machine (in other words, in the plane of the slot 21) is a piston 8 (FIG. 1), extending sideways from the through slot 21. The piston 8 is made in the form of a disk having outer 28 and central thickened 29 parts (FIGS. 5, 7). The outer part 28 of the piston is limited by a spherical surface 31, the radius of which is approximately equal to the radius of the working cavity 4. The transition between the outer part 28 and the central part 29 of the piston is made along a sphere 32, the radius of which is approximately equal to the radius of the central sphere 18. There are two diametrically opposite through slots 33 (FIG. 7) at the outer part 28. A cylindrical hole 39 is made through the slot 33 along the diameter in such a way that it enters the thickened part 29 at a shallow depth and then transitions into a through hole of a smaller diameter 30. The piston 8 and its shaft 27 are made as one whole piece. A sealing synchronizing element (SSE) 44 part, made in the form of a cylinder 60, the end 51 of which is cut by the through-slot 45 for the separator 9 (FIG. 5), is mounted in each cylindrical hole 39 of the piston 8. In order to increase the side surface area of the through-slot 45, projections 46 are provided on the cylindrical part 62 of the SSE 44 sectioned by the through-slot 45 (FIG. 9). A non-sectioned part of SSE 44 contains a coaxial hole for pressing-in a pin (FIGS. 8, 25, position is not numbered). Two parts of the SSE 44, mounted in two diametrically opposite slots 33, are connected by means of the pin 47 (FIG. 8). The pin 47 can be additionally fixed by a contact welding during assembling. There are working medium inlet 12 and outlet 13 openings located from the opposite sides, under and above the ascending (bypass) area 10 of the separator 9 accordingly (below or at the top along the rotor 7 axis), and adjacent to the place of contact between the separator 9 and the rotor 7 (FIGS. 1, 2, 3). Besides, the openings can extent in angular dimension throughout the hole ascending area 10 of the separator 9 and even overlap places of contact of the separator 9 with the rotor 7 conical surfaces 17.

The other types of the pistons, hereafter described, can also be used in this PDRM. In this case, the other parts of the machine only slightly change. The machine characteristics are also little changed (unless otherwise specified). Selection of one or another piston design depends rather on availability of tooling for making the various elements.

Figure 10:
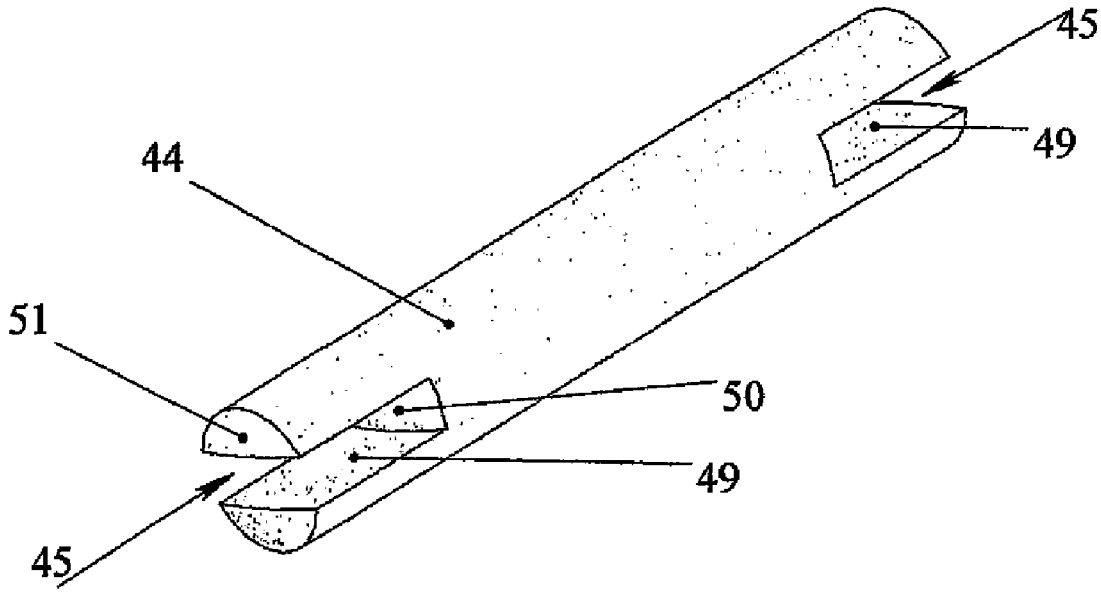
FIG. 10 shows an isometric view of the cylindrical SSE with through-slots at its ends.

This PDRM may also employ a piston 8 (FIG. 9) made without a shaft and equipped with SSE 44 of a simpler shape. SSE 44 is embodied in the form of a cylinder with two through-slots 45 at its spherical ends 51 to accommodate the separator 9. The piston 8 (FIG. 9) differs from the piston 8 (FIG. 7) by the fact that instead of two holes of different diameters 30 and 39, there is only one through hole 30. The SSE 44 interacts with the separator 9 via the side surface 49 of the through-slot 45 and the bottom 50 of the through-slot 45, which has a spherical shape (FIG. 10). The absence of the projections 46 decreases the area of the SSE 44 support and rotation moment arm and can reduce service life of this element, however, at small working pressure differentials and/or the sufficiently thin separators 9, it can be not determining.

Figure 11:
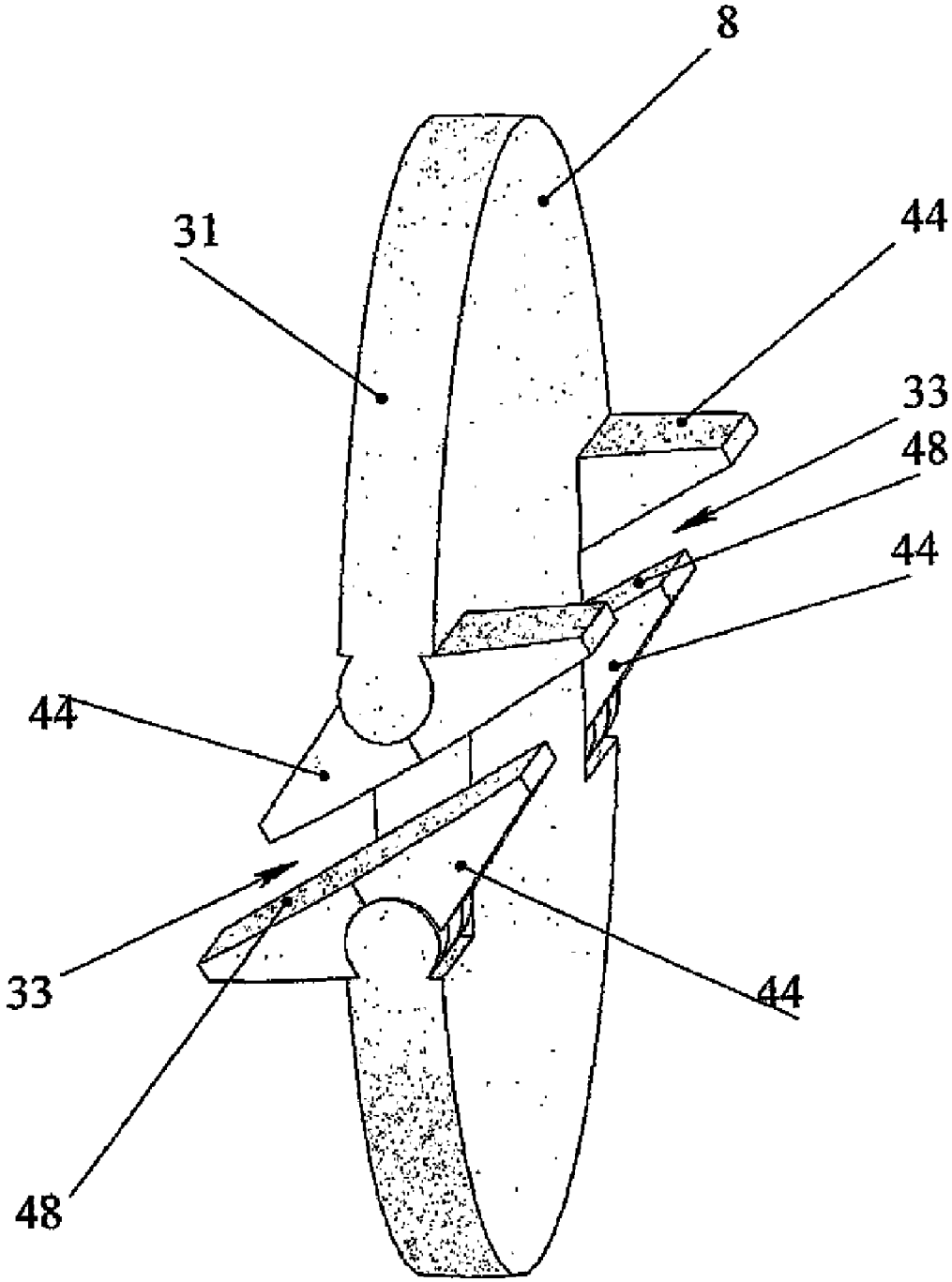
FIG. 11 shows an isometric view of the piston with SSE in the form of the overlays.
Figure 12:
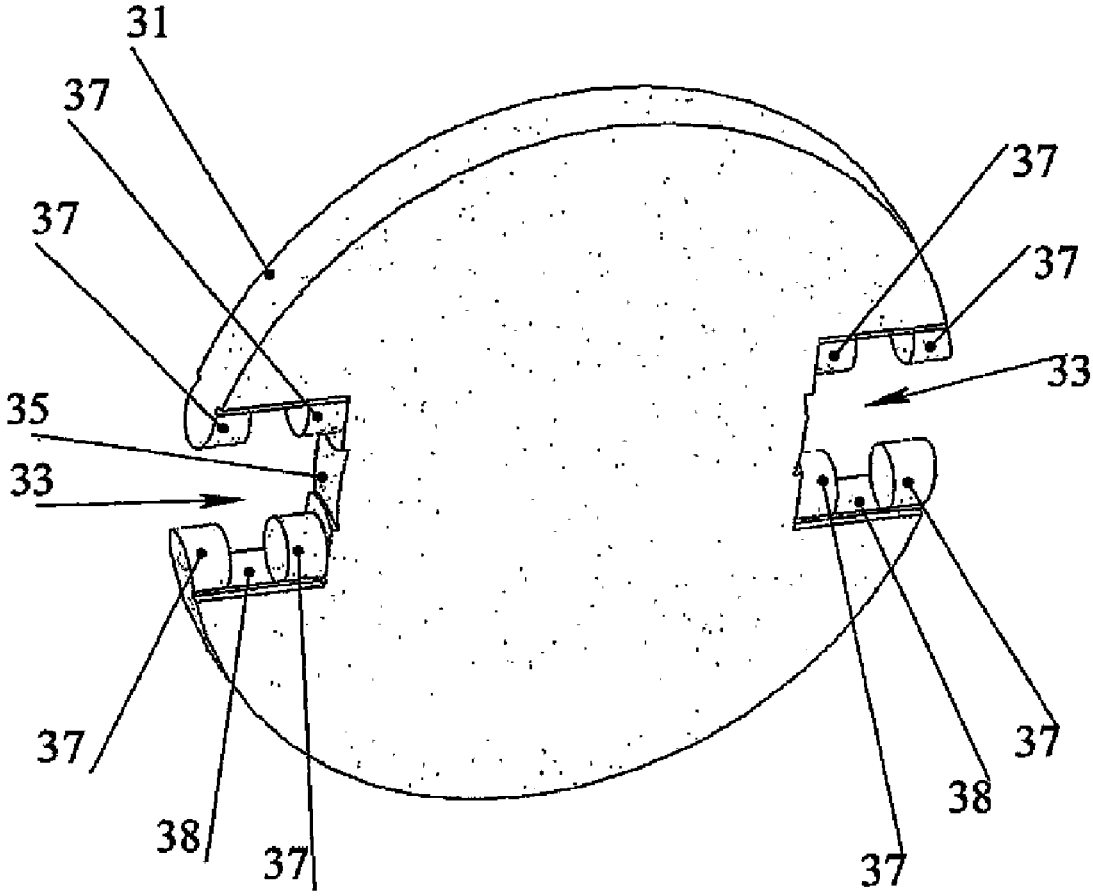
FIG. 12 shows an isometric view of the piston for SSE of FIG. 11.
Figure 13:
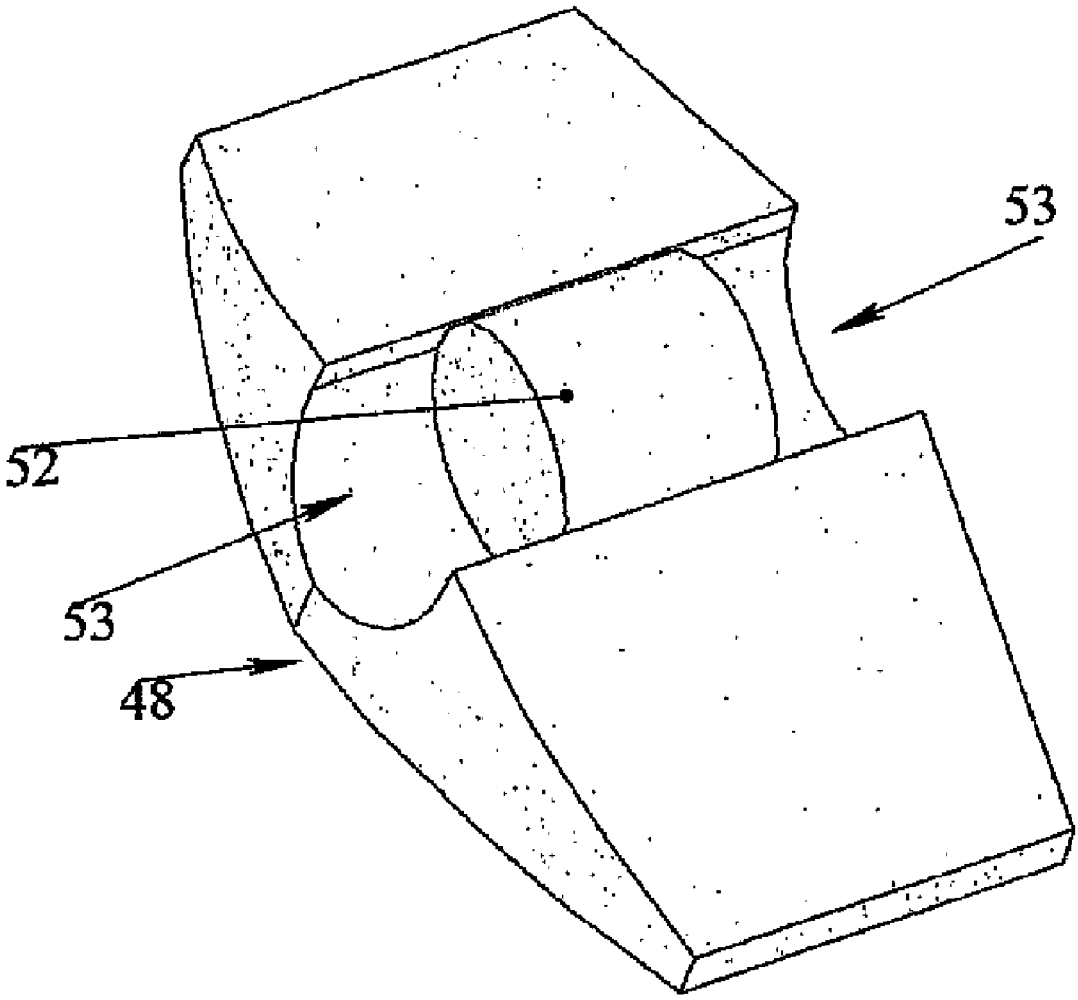
FIG. 13 shows an isometric view of the SSE in the form of the overlay.
Figure 14:
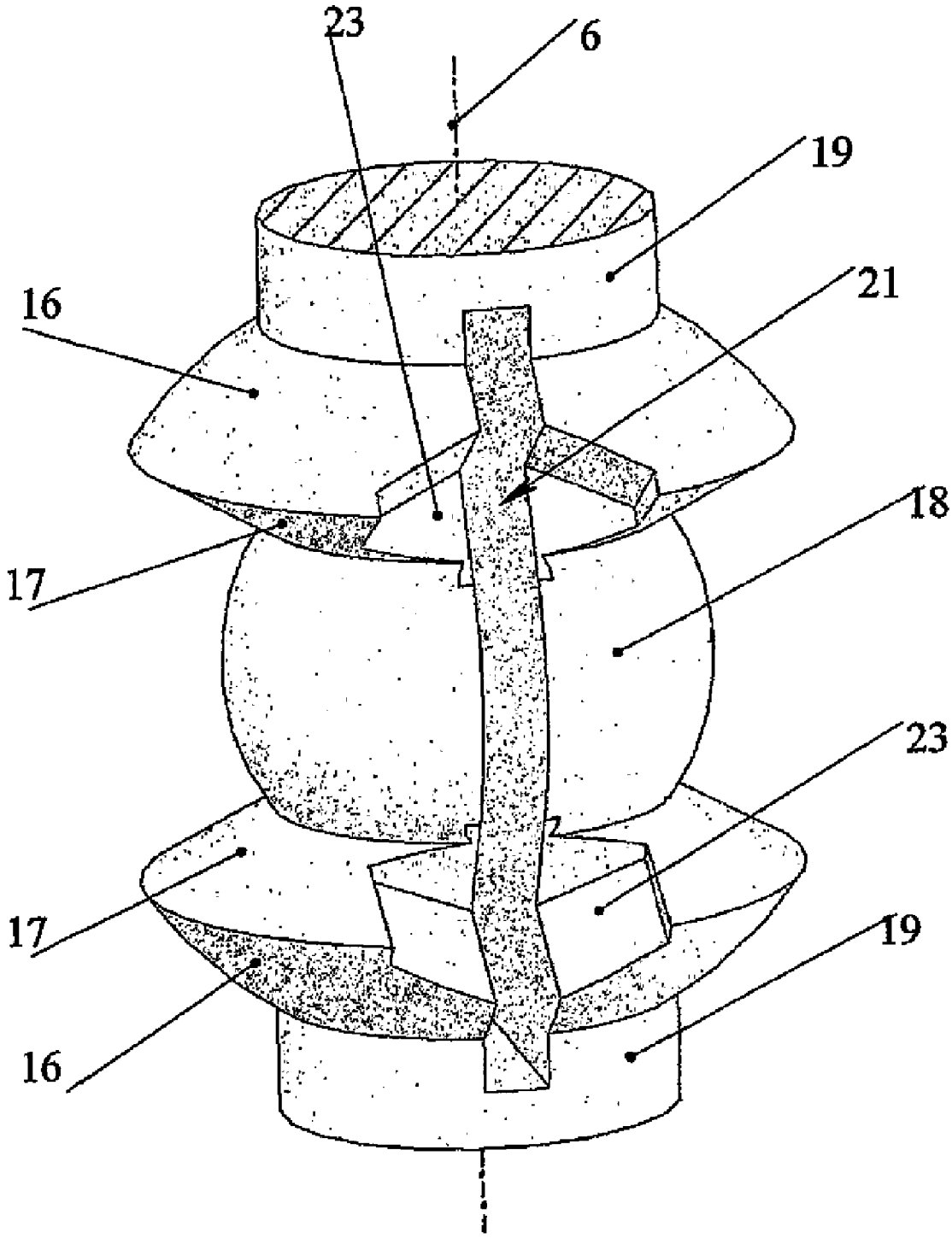
FIG. 14 shows an isometric view of the PDRM rotor with the slot for the piston of FIG. 12.

FIG. 11 shows the piston 8 without the shaft 27 and with the SSE 44 in the form of overlays. On the side surface 36 of the slot 33 of the piston 8 there are two cylindrical projections 37 and a cylindrical recess 38 (FIG. 12). On one side, the SSE 44 has two coaxial cylindrical recesses 53 with a cylindrical projection 52 positioned between them, and on the other side it has a flat area or a part of a conic surface 48 (FIG. 13). The rotor 7 for the piston 8 with such SSE 44 (FIG. 13) has recesses 23 to accommodate SSE in the form of overlays (FIG. 14). The piston 8 (FIG. 12) differs from the piston 8 (FIG. 9) by the fact that it does not have a through hole 30. Such SSE 44 can be additionally fastened to the piston 8 by means of a pin inserted in the SSE 44 and the piston 8 holes, coaxial to the cylindrical projections 37 (not shown).

Figure 15:
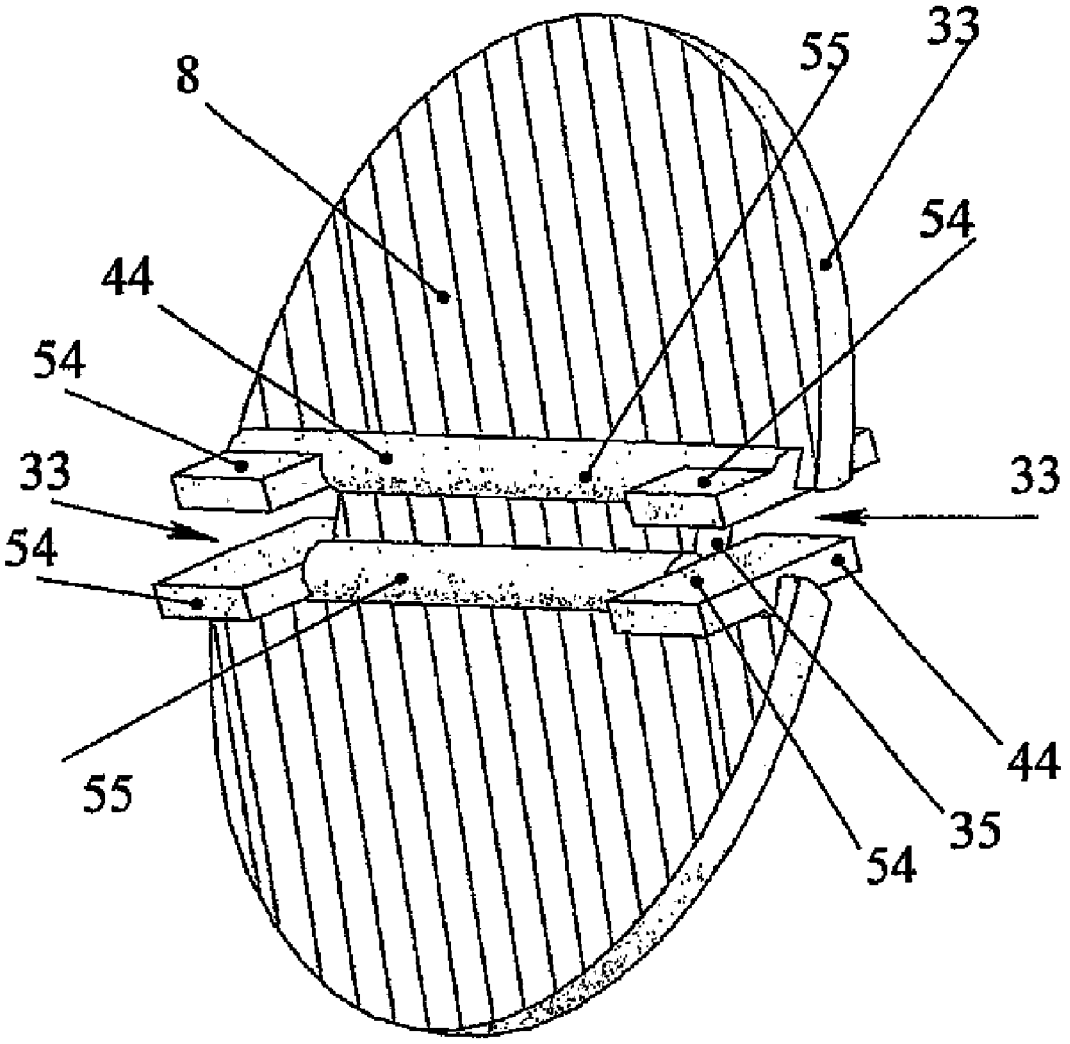
FIG. 15 shows an isometric view of the part of the piston with SSE in the form of two plates connected by means of the shaft.

The SSE 44 can consist of two parts, each of which represents two plates 54 connected via an shaft 55 (FIG. 15). The piston 8 for such the SSE 44 can be assembled of two parts (for example, of two similar disks having the grooves for the SSE 44 shaft 55) by any known means (bonding, rivets, welding and others).

Figure 16:
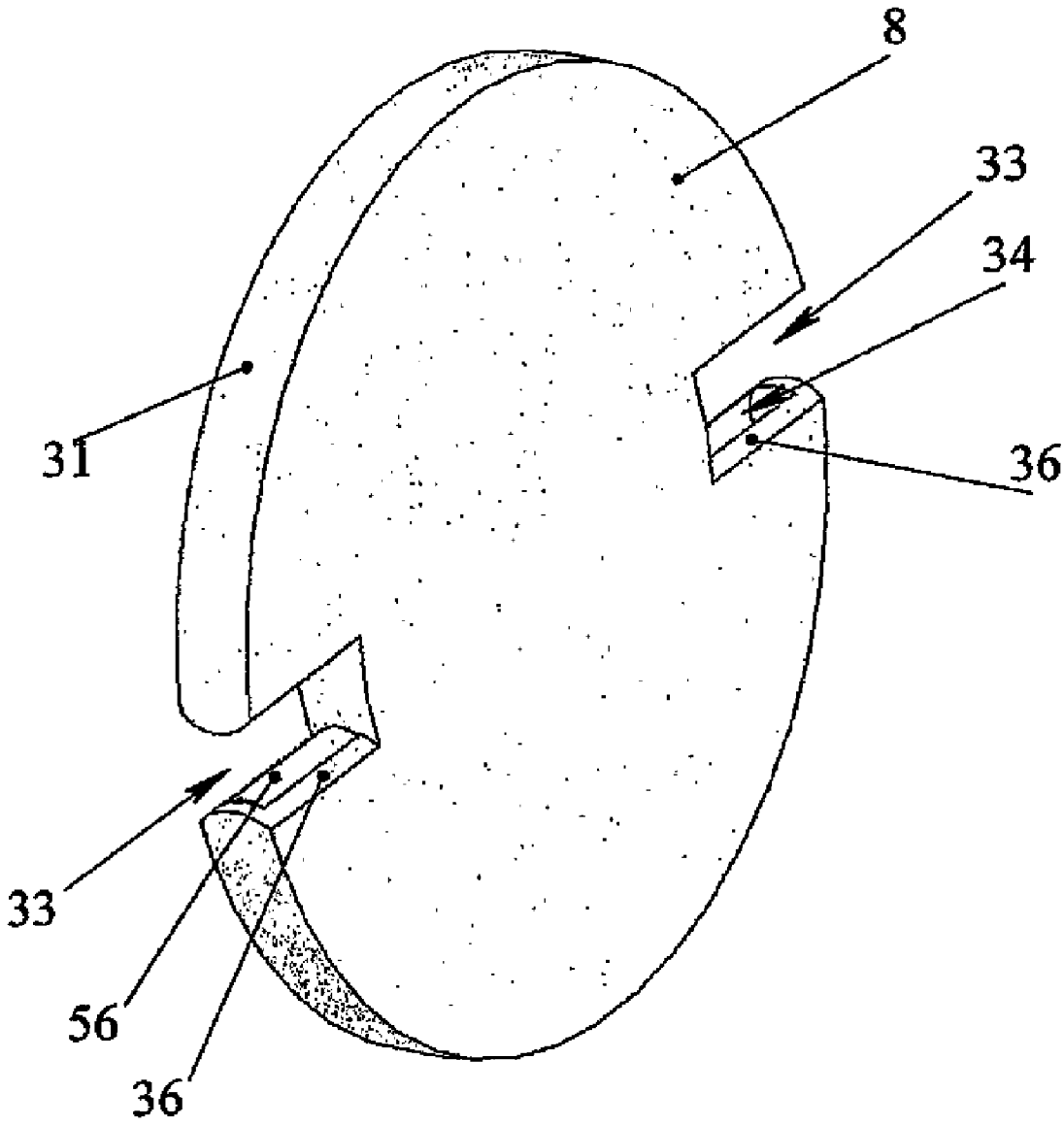
FIG. 16 shows an isometric view of the piston with SSE in the form of the rollers.

The SSE 44 can be made in the form of the roller 56 (FIG. 16), located in the recess 34 on the side surface 36 of the piston 8 slot 33.

Figure 21:
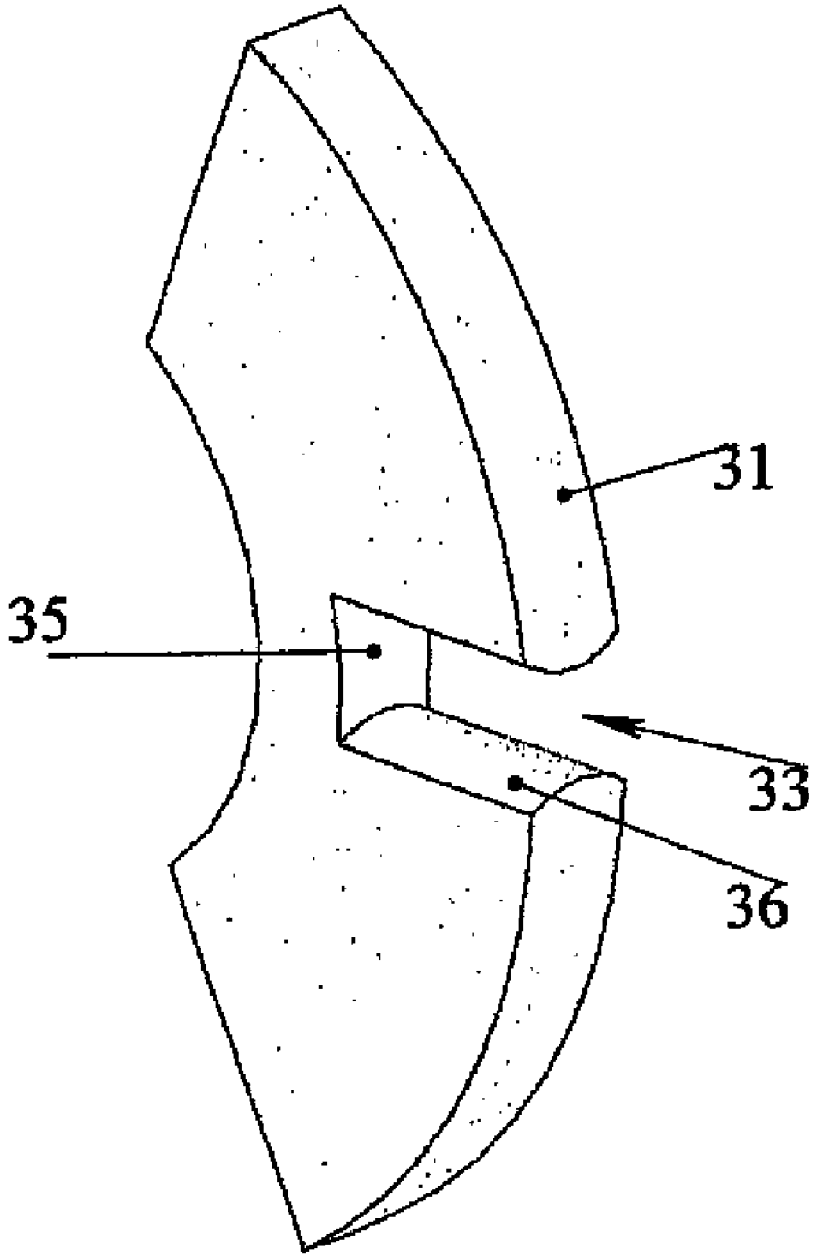
FIG. 21 shows an isometric view of the PDRM piston in the form of a part of a disk with the through-slot.

The piston 8 can be made without the SSE 44 (FIG. 21).

In order to reduce wear of the mechanical synchronization at high revolutions, piston 8 can be lightened. This can be effectively done by removing material from the parts of the piston 8 close to the axis 6 of rotation of the rotor 7, by using material with lower density (especially in the specified areas), or by eliminating these parts of the piston 8. In the latter case, by removing parts of the piston 8, the length of one stage of the pump can be reduced.

Figure 17:
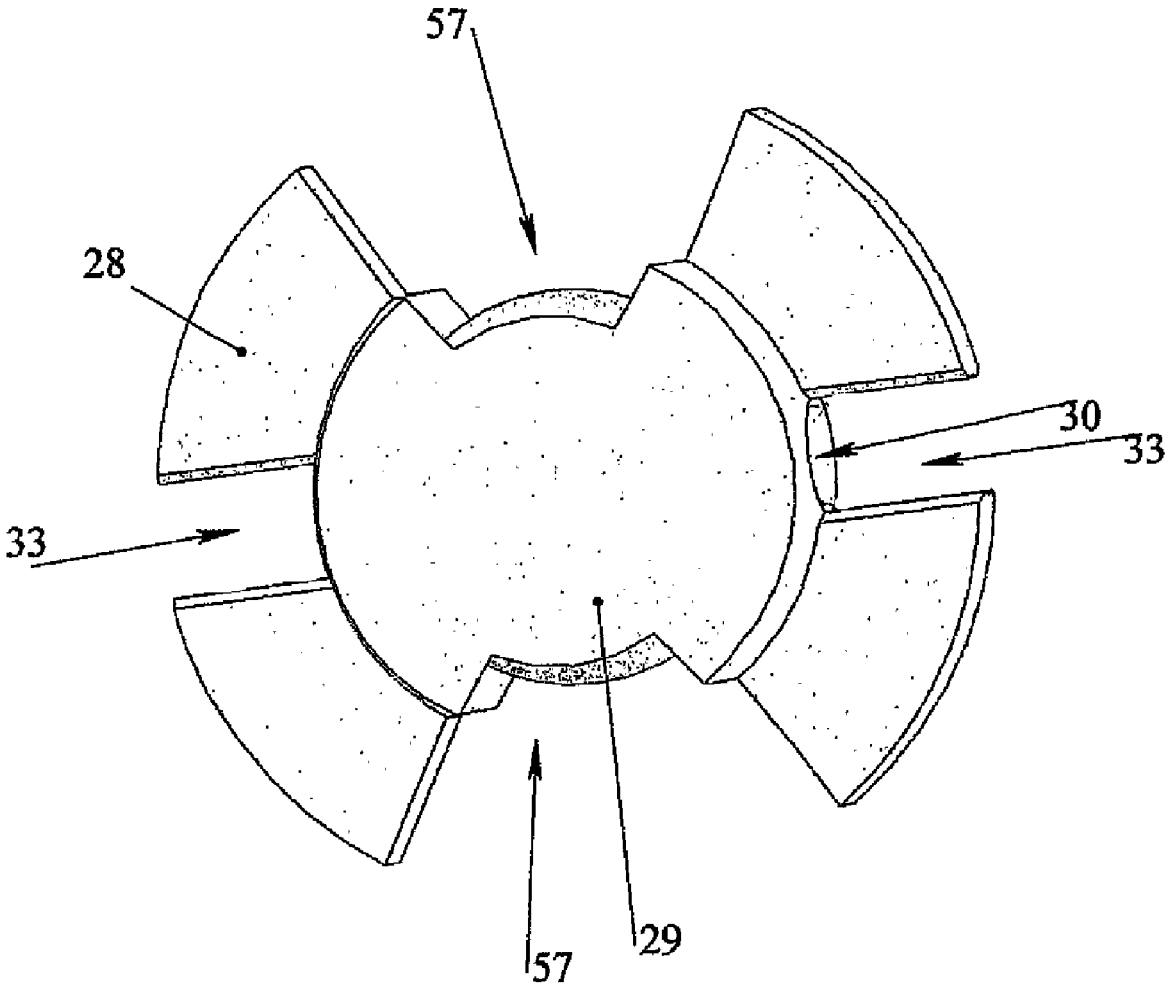
FIG. 17 shows an isometric view of the piston with a weight decrease hollow and through-hole for SSE.

FIG. 17 shows the lightened version of the piston 8. The lightening is represented by the weight decrease hollows 57 in material, from the parts of the piston 8 close to the axis 6 of the rotor 7 rotation and distant from the piston 8 shaft. Hollows 57 could be blind or could be filled with inserts from a lighter material.

However, at small sizes of the machine and/or at low speeds of the machine operation, or at making the whole piston 8 of sufficiently light material, the hollows 57 are not required; in this case, they just reduce the area of the piston 8 support.

Figure 18:
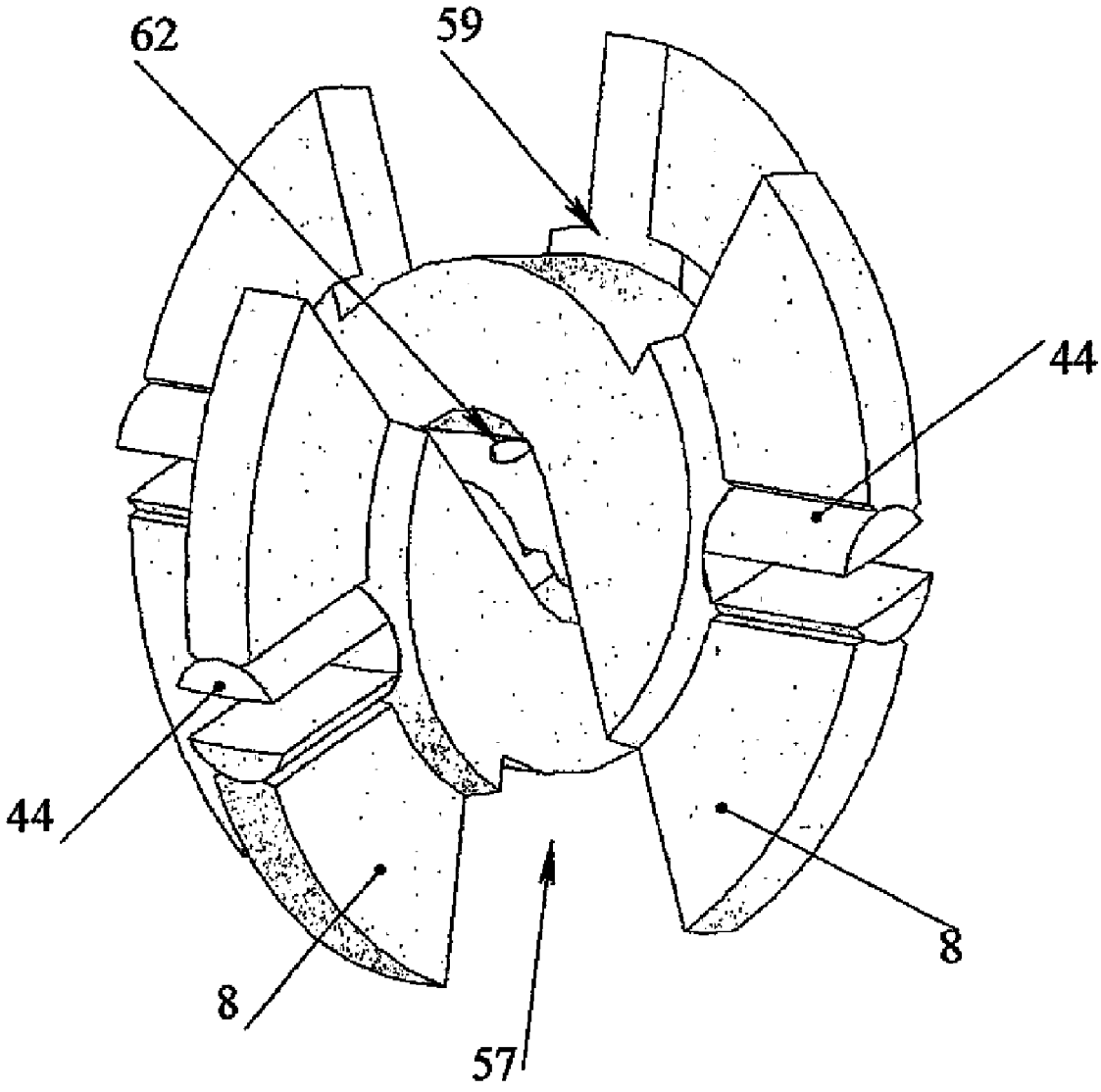
FIG. 18 shows an isometric view of two pistons with weight decrease hollows and cutouts as well as with SSE forming an articulated cross.

Another aspect of the machine modification has to do with increasing the number of pistons 8. For example, in case if the stage pressure differential or the machine tightness is required to be increased. To do that, the number of slots 21 in the rotor 7 has to be increased. FIG. 18 demonstrates an example of making and mutually positioning two or more pistons 8.

Figure 19:
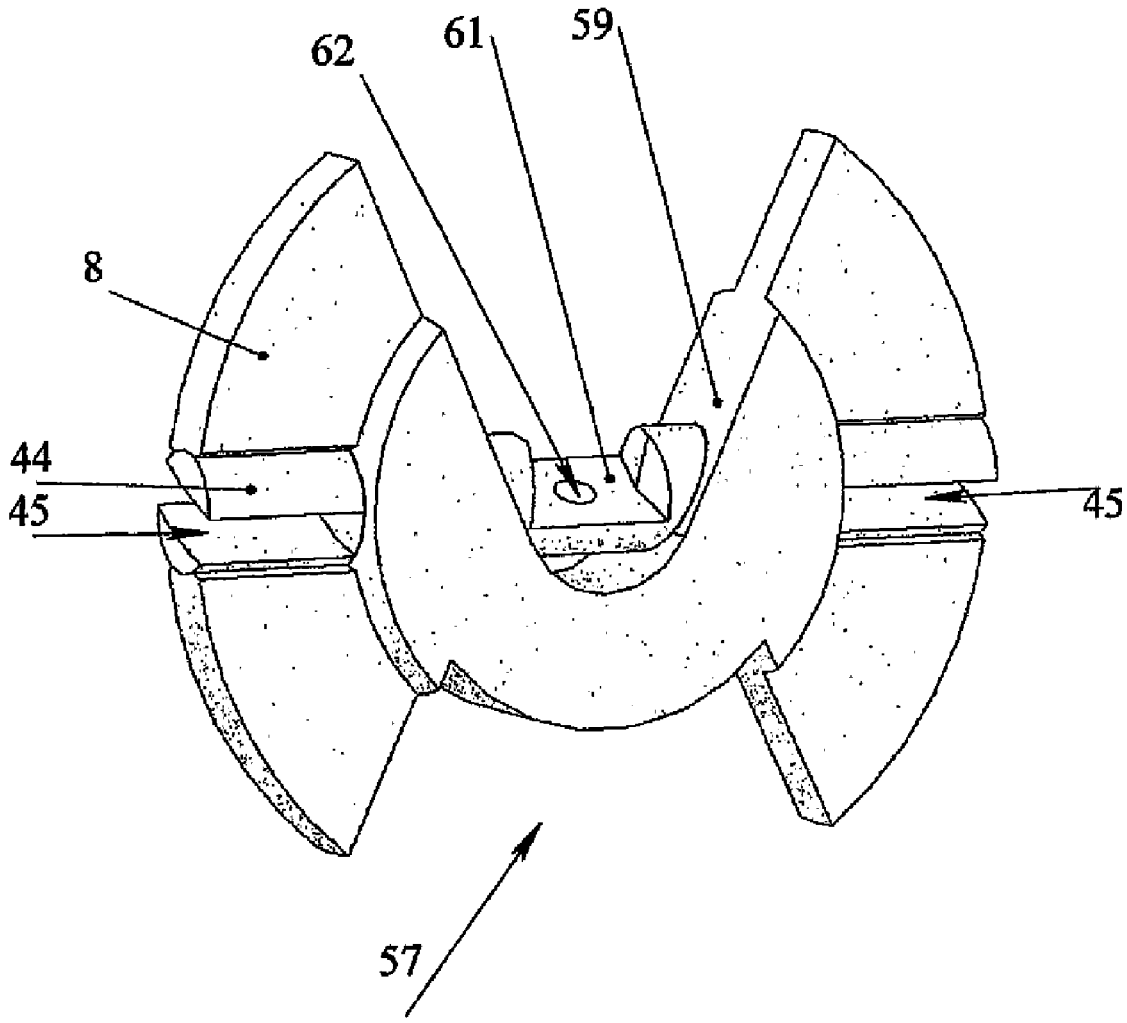
FIG. 19 shows an isometric view of one piston with a weight decrease hollow and a cutout as well as SSE with a cutout for the articulated cross.

In the central part of the piston 8 with the hollows 57, there is an additional cutout 59. As a result, two extended parts of the piston 8 are connected to each other via one or two arches, thus enabling the pistons 8 to cross at an angle with respect to each other without interfering with their oscillations relative to the rotor 7. A hollow space in the center of each piston 8 enables mutual movable joint of SSE 44 shafts in the shape of an articulated cross (FIG. 19). To achieve this, a cutout 61 is made in the central part of SSE up to the middle of the cylinder. To ensure better rigidity, the articulated cross can be secured via a shaft though the hole 62 in the SSE cutout 61. The articulated cross allows using a simple SSE of FIG. 9 by eliminating its disadvantages.

Figure 20:
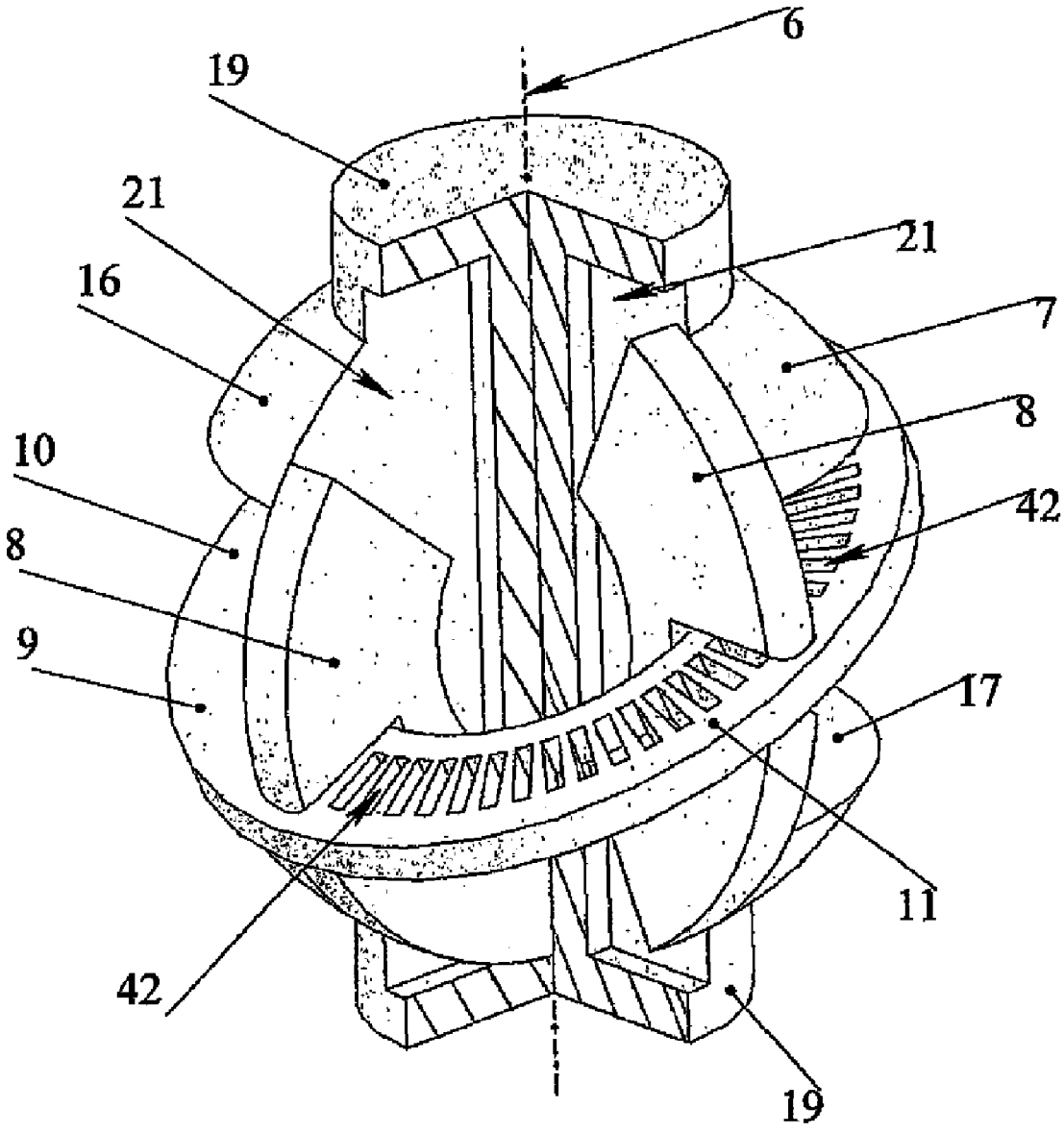
FIG. 20 shows an isometric quarter-size cut-away view of the rotor of the one stage of PDRM with four pistons and the separator.

Another way of adding pistons 8 is shown in FIG. 20: by way of making part-through slots 21 in the rotor 7 and placing pistons 8, embodied in the form of the disk sector less than 180 degrees, in each of them (FIG. 21). In this case, pistons 8 can be retained due to contact with the separator 9 along the flat (conic) surface 63 and along the spherical (cylindrical) surface of the separator 41 and/or along the spherical surface 24 of the body 1.

In case of the blind slots 21 as well as in case of the overlapping of hollow 57 (FIG. 20, FIG. 17) by the rotor 7, machine flow rate could be increased resulting from losing torque by the piston 8, provided by working medium pressure, or it could be not done. It depends on location of the grooves (passes) for working medium bypassing from restrained volumes. If the restrained volumes communicate with a high pressure chamber, the flow rate is increased, and if these volumes communicate with a low pressure chamber then torque is successfully maintained.

Figure 22:
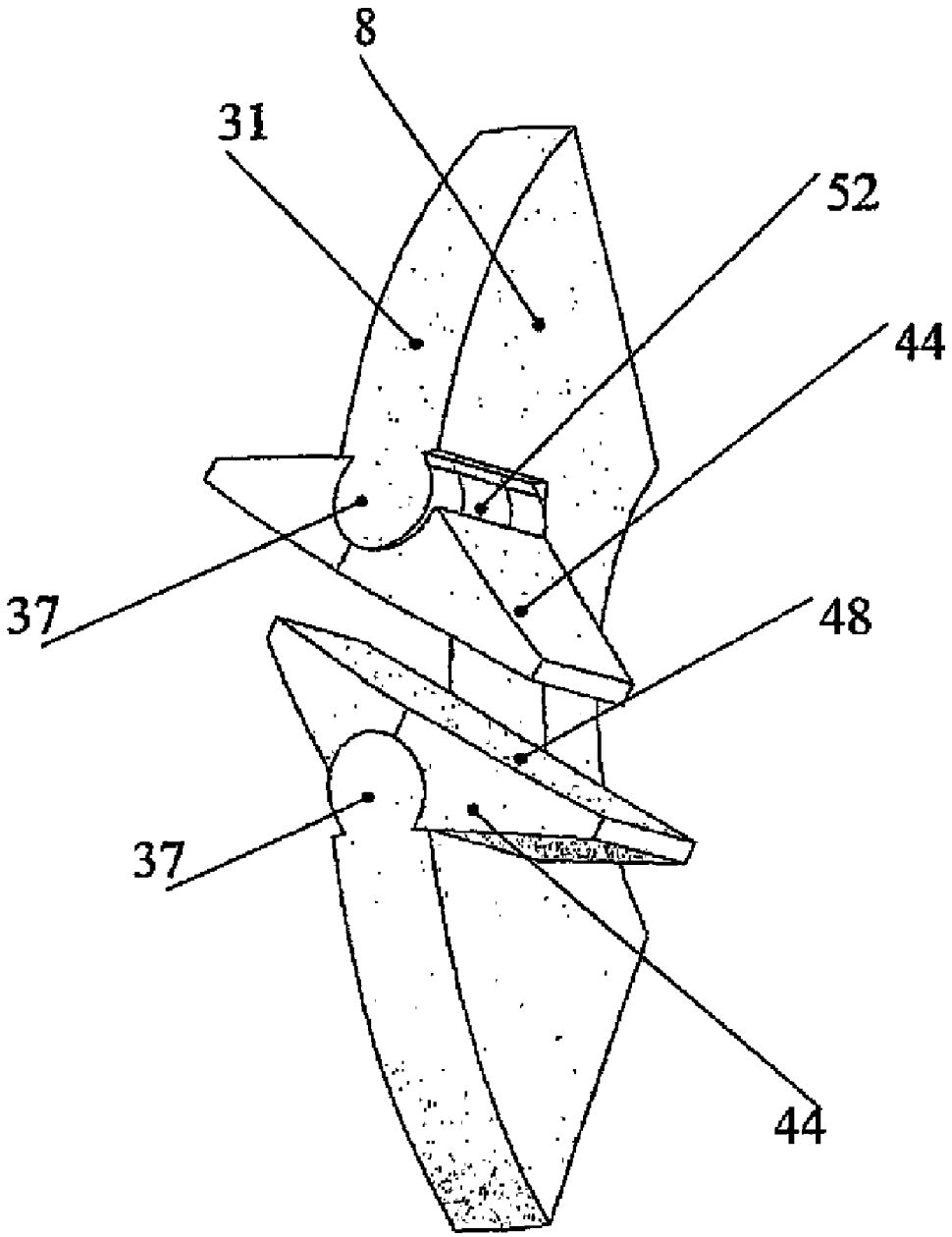
FIG. 22 shows an isometric view of the piston in the form of a part of a disk with the through-slot and the SSE in the form of the overlays, which can operate together with the rotor of FIG. 20.

FIG. 22 shows the piston 8, which differs from the piston 8 (FIG. 21) by the presence of SSE 44 (FIG. 13). For such pistons 8, there can be grooves made inside the slots 21 of the rotor 7 or on the piston 8 surface to exclude trapping of fluid.

In this case, the pistons 8 can be retained due to contact with the separator 9 along the flat (conic) surface 25 and along the spherical (cylindrical) surface 41 of the separator 9 and/or along the spherical surface 24 of the body 1.

In this case, the gaps on the sphere 24 can be automatically eliminated as a result of compression due to centrifugal forces and forces caused by pressure of the working medium. Gaps associated with the separator 9 can be eliminated if the thickness of the separator 9 increases towards the periphery.

Figure 23:
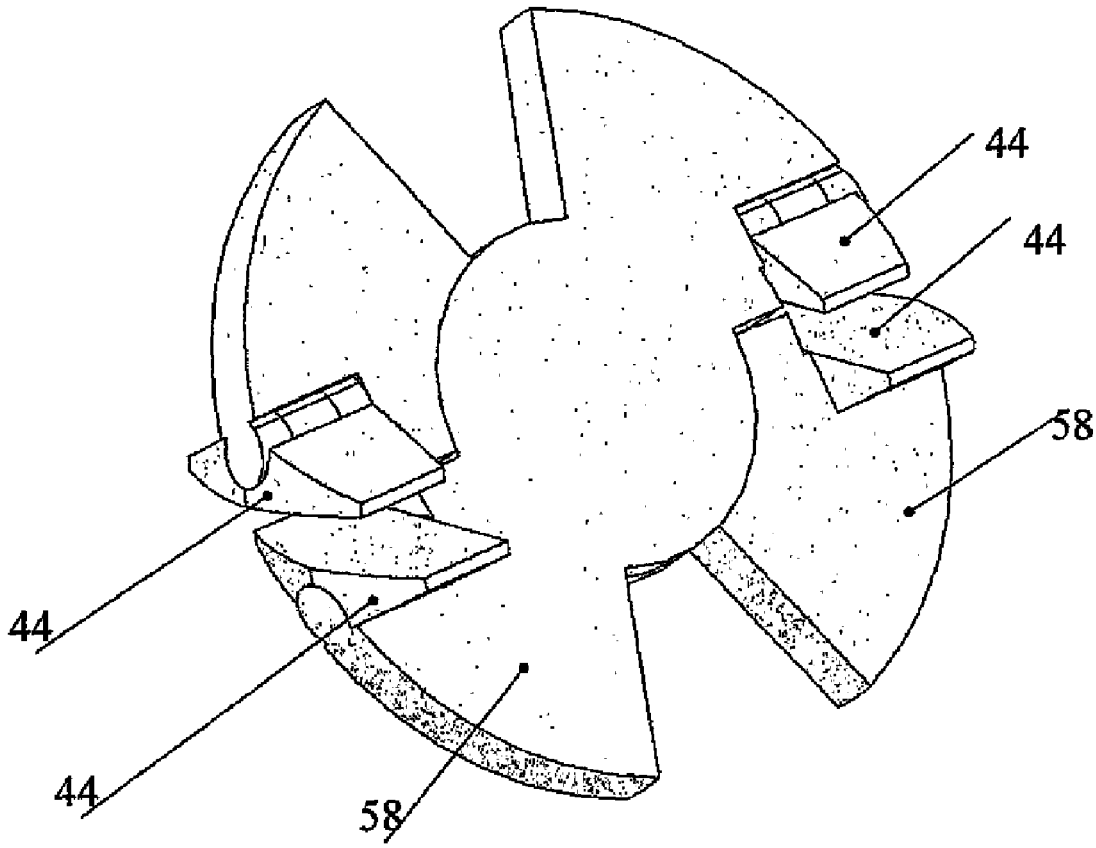
FIG. 23 shows an isometric view of the piston of "scissors" type.

To ensure automatic elimination of the gaps between the separator 9 and the slot 33 of the piston 8 or SSE 44, the piston 8 is embodied in the form of scissors (FIG. 23). Such piston 8 consists of two parts 60. Pistons 8 of such type can be made with or without SSE 44. In the latter case, service life and sealing can be provided by the larger rubbing part of the piston 8, while in case of the SSE 44, service life is determined by operation of the less loaded friction pair.

In this case, compression of both parts 60 of the piston 8 can be realized by:

centrifugal forces acting on parts 6 of the piston 8, centrifugal forces acting on the additional wedging element, spring, pressure of the working medium.

The piston 8 can be mounted using different methods. Selection of mounting procedure depends on parts manufacturing accuracy capability, friction pair availability and others.

The piston 8 can be manufactured together with the rotation shaft 27 as a whole, in which case the rotor 7 is made split (FIGS. 1, 6, 25). Two parts of the rotor 7 can be fastened together by any known means depending on the rotor 7 material: glue, welding, screws, bushing pressing and others.

The piston 8 can be manufactured with the shaft 27 pressed in, in which case the shaft has a hole for inserting a pin.

The piston 8 can be manufactured with the shaft 27 pressed-in (which has a hole, not shown in figures, for the shaft 47 of the SSE 44 of FIG. 8). In this case, the rotor 7 can be solid.

The shaft 27 is pressed in the piston 8 after the piston 8 insertion into the rotor slot 21. Then, the shaft 27 can be additionally fixed, for example, by contact or ultrasonic welding.

The piston 8 can be manufactured with sockets instead of the shaft 27 to provide fixation in the rotor 7 by means of the pins.

The piston 8 can have no additional fixation in the rotor 7 (to hold in a working position by means of the separator 9 and/or the body 1). Thus, the less gaps between the SSE 44 and the separator 9 can be obtained.

The piston 8 can be centered due to the form of the slot 21 of the rotor 7.

From the displacement processes point of view, it is convenient to talk about the quantity of displacers extended into the working chamber, independently on how they are designed inside the rotor 7, how they are secured and balanced. However, from the perspective of dynamic centrifugal and inertial loads, sealing properties, and loads applied to the friction pairs, it is important to know internal design and mounting method of the pistons 8. In particular, it is important whether the two extended parts of the piston 8 are the parts of the same piston 8 or different ones, whether piston 8 contains SSE 44 extended into diametrically opposite sides of the working chamber or just one side, whether the separator 9 is embraced by the one-piece SSE 44 or by the one made of separate parts located on the opposite sides of the separator 9.

Figure 24:
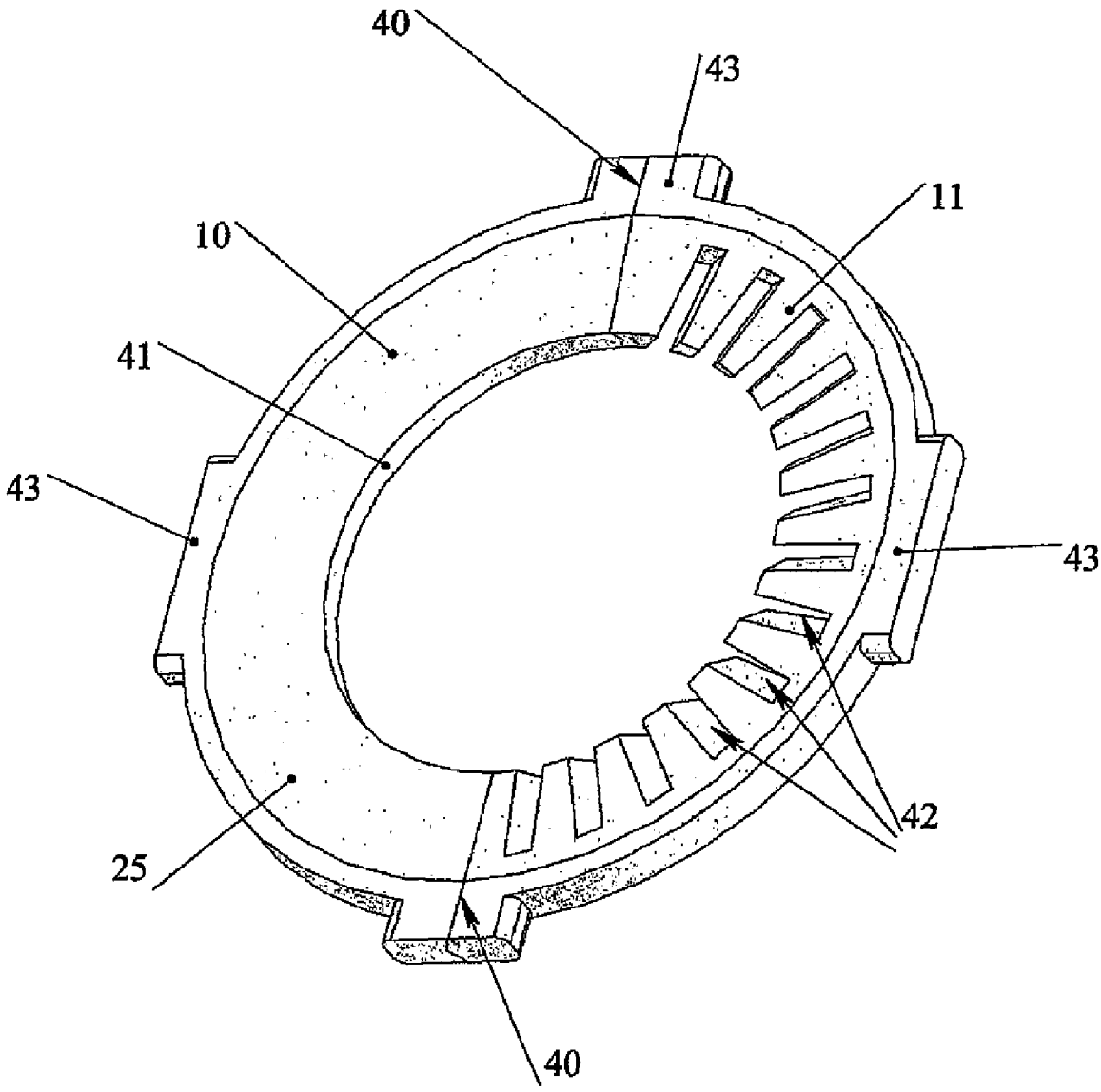
FIG. 24 shows an isometric view of the separator with the conical working surface, the legs and the slotted passes at the descending part.

For convenience of fastening the separator 9 to the body 1, the ascending 10 and descending 11 parts of the separator 9 of FIG. 24 have legs 43. In this case, mating slots for the legs 43 are made in the body 1. The descending part 11 of the separator 9 also has the through passes 42 in the form of the splits. The through passes 42 can be opened to inner surface 41 of the separator 9. In order to reduce resistance to the working medium flow, the through passes 42 in the form of the splits and the holes 42 can be made at an angle to the separator 9 axis in the direction of the working medium movement.

The PDRM operates as follows. At the rotor 7 rotation, one of the piston 8 parts, extended into the working cavity 20 at the descending area 3 of the body 1, closes off the working cavity 20 dividing it into two working chambers of decreasing volume (in front of the piston 8) and increasing volume (behind piston 8). Besides, the piston 8 through slot 33 is closed off (shut-off) by the separator area 11 with the through-passes 42, allowing the working medium to move along the rotor 7 rotation. The working medium leaves the decreasing working chamber 20 through the outlet opening 13 at the ascending area 10, and enters the increasing working chamber 20 through the inlet opening 12 at the ascending area 10. In this case, the piston 8 turns around relative to the rotor 7, interacting directly by means of the slot 33 or through the SSE 44 with the separator 9. Once this part of the piston 8 gets into the bypass zone (inlet 12/outlet 13 openings), it is replaced with the next piston 8 extended part either immediately or in some time. If more than two extended parts of pistons are present (in machines with two or more pistons 8), several extended parts of the piston can push working medium through the working cavity 20 at the descending area 11 simultaneously.

The other extended parts of the pistons 8, moving along the ascending area 10 of the separator 9 (may be, except for its ends), is little subjected to (do not produce) pressure differential as they pass through the bypass zone. The process is repeated.

In the machines under consideration, a phenomenon of the piston 8 torque, provided by medium pressure and acting towards its rotation, is exist. It can be of use just for the pistons 8 extended from the rotor 7 in both sides. For other pistons 8, at restrained volume presence, torque is eliminated by making passes from the restrained volume to the chamber in front of the piston 8. The torque value is proportional to the thickness of the piston 8 part, extended from the rotor. Therefore, the thickness of this piston 8 part shall be selected based on the ratio of the piston 8 shaft friction torque to piston 8 pressure differential. Calculation procedure is not given in view of its evidence.

When building the multistage machine, it is reasonable to make several rotor stages at one rigid shaft to eliminate radial load on shaft bearings. Besides, the bodies of each stage shall be turned to a small angle relative to each other or according to the system shown in FIG. 26: 0 degrees, 180 degreed, 180 degrees, 360 degrees and so on. Moreover, duct 15 for turning the working medium flow around the rotor 65 is made at intervals of two stages. The rotor balance in respect of working medium pressure results in a minor increase of the pump length (provided that there is no diameter limitation, this turning around can be performed outside the diameter of the working cavity).

Figure 26:
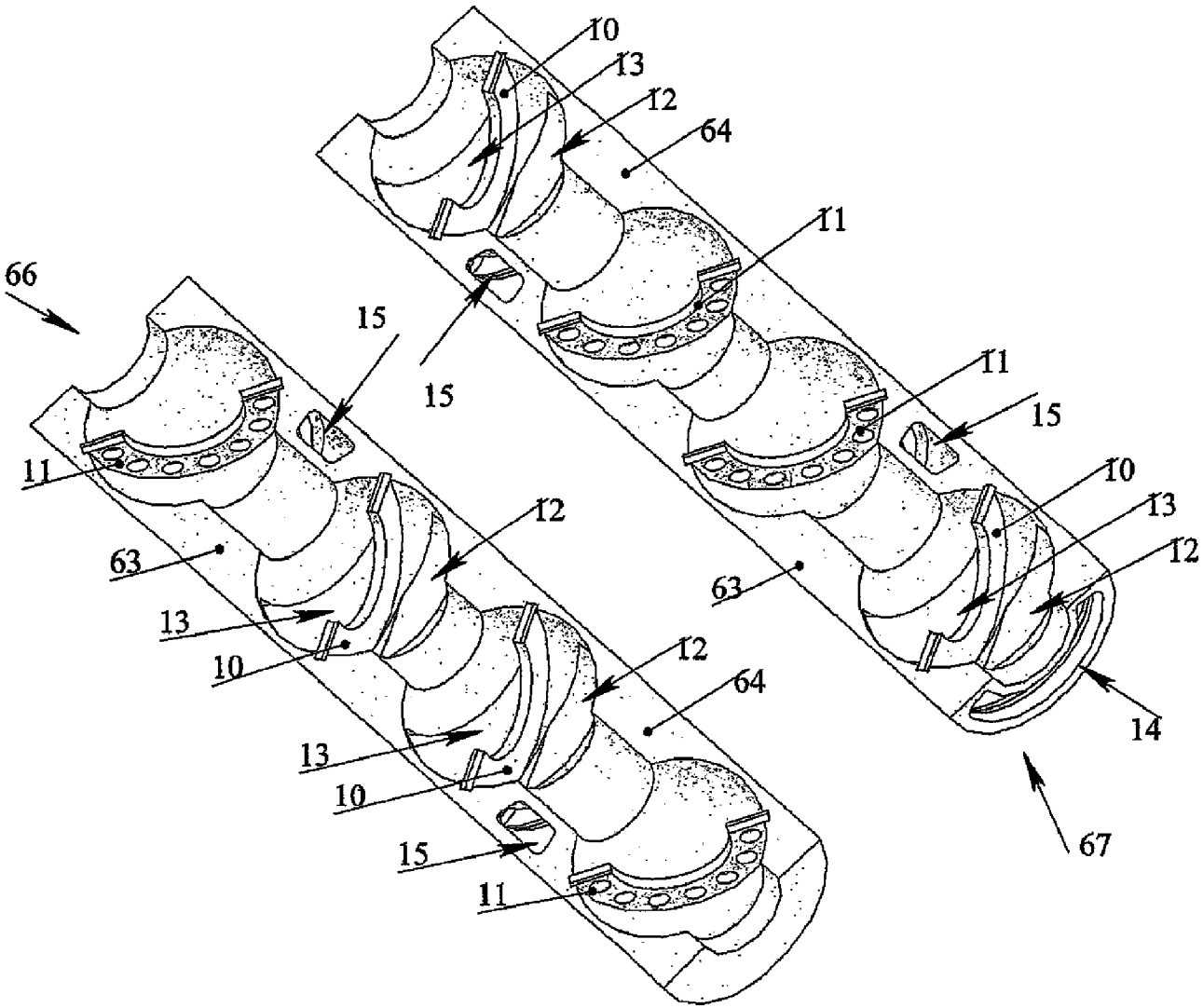
FIG. 26 shows an isometric view of two body parts of the four-stage PDRM, consisting of the parts shown in FIG. 25.

The multistage PDRM, minimum specific two-stage part of which (to illustrate on a larger scale) is presented in FIG. 25, consists of several parts of that kind, for example, of two, just as four-stage body of FIG. 26. Besides, to provide the higher rigidity, it is desirable that all parts 63, 64 of halves 66 and 67 of the multistage body form an integral unit. What is more important is that all or at least two parts 65 of the rotor 7 form an integral unit. It allows to decrease the radial loads on the machine bearings. The specific part of the body consists of two halves 63 and 64, in the slit plane of which machine axis 6 is located. The specific part of the first body half 63 consists of descending discharge part 3 of the body of a stage, followed by the duct 15 (FIGS. 1, 25, 26) for turning the working medium flow around the rotor 65, entering inlet opening 12 of ascending bypass part 2 of the body of a stage, going next. The specific part of the second body half 64 is arranged in a reverse order and consists of the ascending bypass part 2 of the body of a stage, out of outlet opening 13 of which the duct 65 for turning the working medium flow comes and further goes around the rotor 65, followed by the descending discharge part 3 of the body of a stage. Ducts 15 for turning the working medium flow around the rotor 65 are opened on slit planes of halves 63 and 64 at one and the same place so that after assembly a single duct, connecting first-stage outlet opening 13 of the second part of the body with second-stage inlet opening 12 of the first part of body, is obtained. The first 63 and second 64 parts of the body area can represent one and the same component (may be except for direction of joint 40 on the separators 9). For illustrative purposes, the area of two stages of slit rotor 65 is shown. The slit plane contains the machine axis 6. Fastening of the rotor halves 65 is not shown. Any known means of fastening can be used: glue, welding, screws and others. The solid rotors with slots for the pistons, the stages of which are shown on other figures, can be used instead of the slit rotor 65. The pistons, separately shown in FIG. 5, are presented in FIG. 25.

A number of stages of such machine can be increased by adding the same specific parts 63 and 64 turned around the machine axis 6 on the 180 degrees. It is reasonable to install the intermediate radial bearings at some distance, depending on loads and rigidity of the rotor 65, although if wear-resistant coatings of the rotor and the body are available, it can go without bearings.

Two body halves 66 and 67 of four-stage machine (FIG. 26) are obtained from the specific parts (FIG. 25). In some cases, it is favorable to add half-bodies of radial and/or thrust bearings to their ends.

In the embodiments presented, many forms are illustrative, convenient, but just recommended. Thus, the spherical surface 16 of the rotor 7 is nonobligatory. The rotor 7 conical surfaces 17 can have other form provided that their profile is mating with the separator 9 profile. And even this can be violated when a large number of the pistons 8 is used as the rotor 7 conical surfaces 17 contact with the separator 9 becomes nonobligatory (closing off the camera section, adjacent to this point, by one of the pistons 8 is enough). The spherical form of "the central sphere" 18 is not strictly obligatory. It can be replaced, for example, by a cylinder resulting in a small loss of tightness. Even spherical surface 24 of the working surface of the body 1 can be made slightly toroidal (for example, within tolerance for the rotor 7 play). The deviations of the working surface of the body 1 to toroidality, when using the pistons 8 in the form of a part of a disk of size less than a half, are far less significant. Such deviations result in minor deviations from a flat form of the separator 9, somehow reduce the area of the piston contact over the body, but do not violate the machine operability. Another cause of deviations from the body working surface sphericity can be smearing of boundary between this surface 24 and the separator 9, although it also results in reducing the surface of the piston 8 contact with the body 1.

Figure 27:
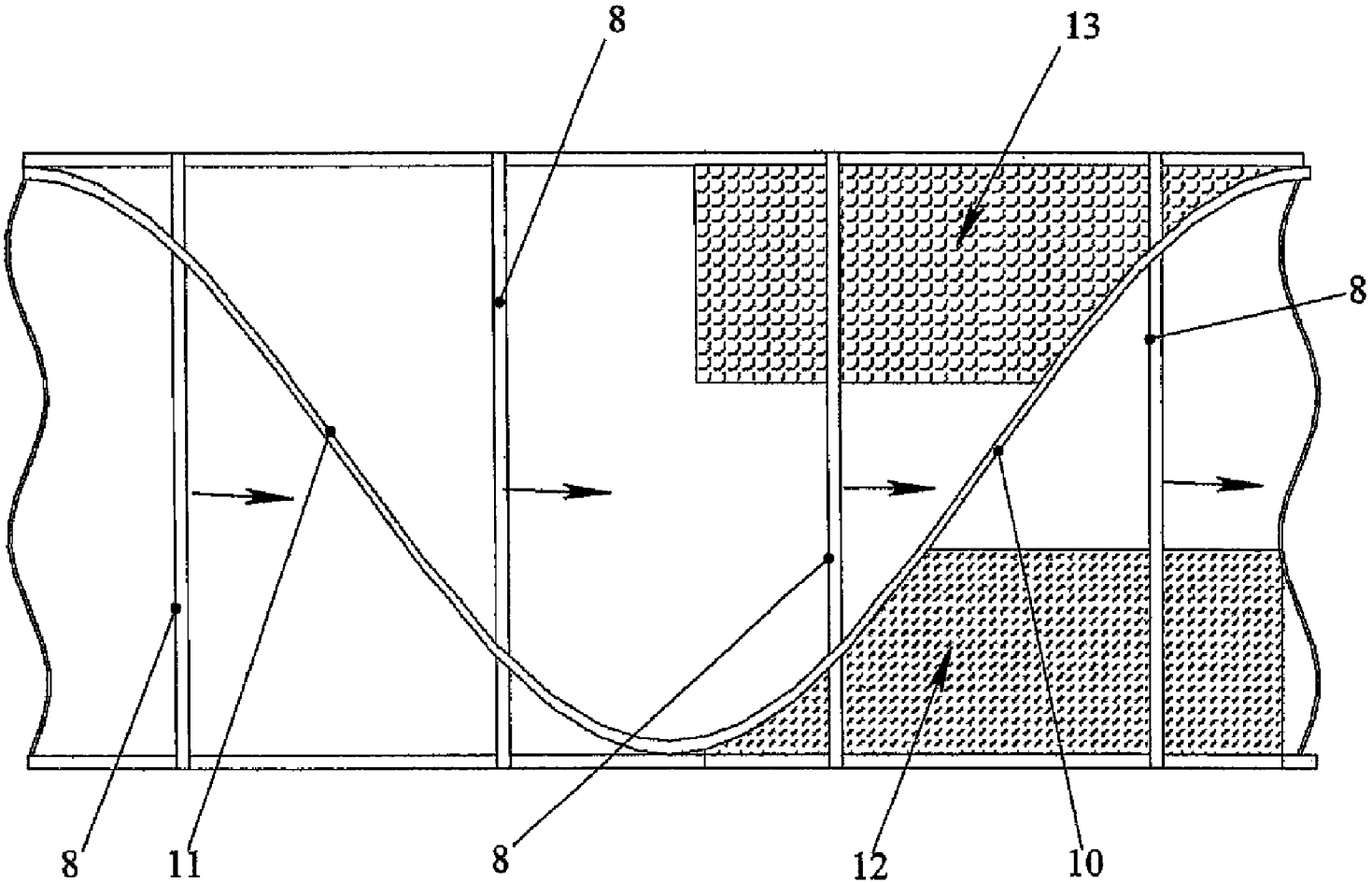
FIG. 27 shows a chart, illustrating the PDRM stage operation.

Four-piston 8 machine stage operation is explained by the chart (FIG. 27). It shows two pistons 8 moving along the descending (discharge) area 11 of the separator 9 and of the body at the rotor 9 rotation. Besides, each of them produces a pressure differential, giving the pressure differential of one stage of the pump in total. When turning around, the specified extended parts of the pistons 8 move downwards interacting with the separator 9. Another pair of the pistons 8 moves along the ascending (bypass) area 10 of the body 1 and the separator 9. They do not produce pressure differential. When one of the pistons 8 leaves the discharge part 11, it is replaced by the piston 8, leaving the bypass part 10. The process is repeated.

The invention claimed is:

1. A positive displacement rotary machine comprising:

a body with a spherical working surface having bypass and discharge parts;

a rotor with a rotor working surface rotatably mounted in the body;

a ring working cavity formed by the spherical working surface and the rotor working surface;

a separator embodied in the form of a washer, fastened in the body at an angle to the plane of the rotor rotation and dividing the ring working cavity into two parts;

the separator is conditionally divided into an ascending area and a descending area, located at the bypass and the discharge parts of the body accordingly;

and working medium inlet and outlet openings are located on the opposite sides of the ascending area of the separator;

the rotor working surface is provided with at least one slot along its geometrical axis of rotation;

and a piston, capable of closing off (sealing off) the ring working cavity and performing rotational oscillations in a plane of the at least one slot, is mounted in each of the at least one slot; the piston is made at least in the form of a part of a disk and there is at least one sealing through-slot for a separator passage in the piston; and also at least one through-pass for a working medium flow, from one separator side to the other is made in the descending area of the separator.

2. A positive displacement rotary machine according to the claim 1, wherein the rotor working surface is made in the form of two coaxial surfaces of truncated cones and a part of a sphere, where the part of the sphere is located between the two coaxial surfaces of the truncated cones.

3. A positive displacement rotary machine according to the claim 1 wherein the at least one slot includes at least two slots, wherein the at least two slots of the rotor working surface are connected at the center of the rotor.

4. A positive displacement rotary machine according to the claim 1, wherein the separator is made in the form of a flat washer.

5. A positive displacement rotary machine according to the claim 1, wherein the separator is made in the form of a washer with a conical working surface.

6. A positive displacement rotary machine according to the claim 1, wherein the separator is mounted in the body so that the opposite sides of the separator are in contact with the rotor.

7. A positive displacement rotary machine according to the claim 6, wherein recesses are made on the separator at the places of the contact with the rotor.

8. A positive displacement rotary machine according to the claim 1, wherein the separator is made in the form of two parts of a washer.

9. A positive displacement rotary machine according to the claim 1, wherein the piston is made in the form of a disk with a spherical side surface and two through-slots for the separator.

10. A positive displacement rotary machine according to the claim 1, wherein the piston is made in the form of a disk with two through-slots for the separator, having weight decrease hollows at the area distant from the slots.

11. A positive displacement rotary machine according to the claim 10, wherein the areas, distant from the slots, are made of materials of lower density.

12. A positive displacement rotary machine according to the claim 1, wherein the piston is made in the form of a truncated sector of a disk with an angle of less than 180 degrees having one through-slot for the separator.

13. A positive displacement rotary machine according to the claim 1, wherein at least one sealing synchronizing element is mounted in the at least one sealing through-slot.

14. A positive displacement rotary machine according to the claim 1, wherein the at least one through-pass is made at an angle to the separator geometrical axis.

15. A positive displacement rotary machine according to the claim 1, wherein the positive displacement rotary machine is made with multiple stages where a common shaft connects each of the rotors in the multiple stages.

16. A positive displacement rotary machine according to the claim 15, wherein ducts for turning the working medium flow around the rotor are made in the body after a first stage and further at intervals of two stages.

* * * * *